US009991063B2

(12) United States Patent
Fuller

(10) Patent No.: US 9,991,063 B2
(45) Date of Patent: Jun. 5, 2018

(54) INTERLOCK ARTICLE

(71) Applicant: Lex Products Corporation, Shelton, CT (US)

(72) Inventor: Travis Peck Fuller, Stratford, CT (US)

(73) Assignee: LEX PRODUCTS CORPORATION, Shelton, CT (US)

( * ) Notice: Subject to any disclaimer, the term of this patent is extended or adjusted under 35 U.S.C. 154(b) by 192 days.

(21) Appl. No.: 14/290,486

(22) Filed: May 29, 2014

(65) Prior Publication Data

US 2015/0348719 A1 Dec. 3, 2015

(51) Int. Cl.
*H01H 9/20* (2006.01)
*H01H 9/26* (2006.01)

(52) U.S. Cl.
CPC ..... *H01H 9/26* (2013.01); *H01H 2221/052* (2013.01)

(58) Field of Classification Search
CPC .. H01H 9/20; H01H 9/26; H01H 3/00; H01H 3/02; H01H 3/04; H01H 3/06; H01H 3/32; H01H 3/34; H01H 3/46; H01H 9/24; H01H 9/28; H01H 27/00; H01H 27/10; H01H 71/02; H01H 71/0207; H01H 71/10; H01H 71/1054; H01H 71/1072; H01H 71/128; H01H 71/46; H01H 71/50; H01H 71/52; H01H 71/526; H01H 71/527; H01H 71/528; H01H 71/56; H01H 2003/00; H01H 2003/002; H01H 2003/02; H01H 2003/08; H01H 2003/10; H01H 2003/32; H01H 2003/46; H01H 2009/2026; H01H 2221/00; H01H 2221/016; H01H 2221/008; H01H 2221/024; H01H 2221/03
USPC ..... 200/50.33
See application file for complete search history.

(56) References Cited

U.S. PATENT DOCUMENTS

| | | | | |
|---|---|---|---|---|
| 2,531,157 A | | 11/1950 | Pifke | |
| 3,069,518 A | | 12/1962 | Soos | |
| 3,705,280 A | * | 12/1972 | Harms | H01H 71/1018 200/50.33 |
| 3,767,872 A | | 10/1973 | Whitchurch | |
| 3,789,169 A | | 1/1974 | Yazvac | |
| 4,034,170 A | | 7/1977 | Raabe et al. | |
| 4,510,357 A | | 4/1985 | Winterbottom | |
| 4,516,100 A | | 5/1985 | Wallace et al. | |
| 4,760,278 A | | 7/1988 | Thomson | |

(Continued)

*Primary Examiner* — Anthony R. Jimenez
(74) *Attorney, Agent, or Firm* — Steven M. McHugh

(57) ABSTRACT

An interlock for a circuit breaker having a first circuit breaker switch and a second circuit breaker switch. The interlock includes a first actuator movably associated with the first circuit breaker switch, a first limiter plate and a first handle securely associated with the first actuator and the first limiter plate. The interlock further includes a second actuator movably associated with the second circuit breaker switch, a second limiter plate, and a second handle securely associated with the second actuator and the second limiter plate. The first limiter plate and second limiter plates are configurable between a first configuration and a second configuration. When the first plate is in the second configuration, the second plate is non-movably configured in the first configuration, and when the second plate is in the second configuration, the first plate is non-movably configured in the first configuration.

20 Claims, 30 Drawing Sheets

(56) References Cited

U.S. PATENT DOCUMENTS

| | | | | |
|---|---|---|---|---|
| 4,827,089 | A | 5/1989 | Morris et al. | |
| 4,902,859 | A | 2/1990 | Witzmann et al. | |
| 4,924,041 | A | 5/1990 | Yee | |
| 5,008,499 | A | 4/1991 | Yee et al. | |
| 5,726,401 | A * | 3/1998 | Green | H01H 9/262 200/50.33 |
| 5,814,777 | A | 9/1998 | Green et al. | |
| 6,181,028 | B1 | 1/2001 | Kern et al. | |
| 6,424,060 | B1 | 7/2002 | Shiely et al. | |
| 6,541,719 | B1 | 4/2003 | Powell | |
| 6,686,547 | B2 | 2/2004 | Kern et al. | |
| 6,777,628 | B2 | 8/2004 | Azzola et al. | |
| 6,872,900 | B1 | 3/2005 | Lament et al. | |
| 7,126,068 | B2 | 6/2006 | Fillppenko | |
| 7,462,792 | B1 | 12/2008 | Hellmers et al. | |
| 7,465,892 | B2 | 12/2008 | McCoy | |
| 7,834,282 | B2 | 11/2010 | Flegel | |
| 8,183,481 | B2 | 5/2012 | Zinchuk et al. | |
| 8,237,070 | B2 | 8/2012 | Zhang | |
| 8,369,068 | B2 | 2/2013 | Jonas et al. | |
| 8,395,883 | B2 | 3/2013 | Takata et al. | |
| 2004/0045796 | A1 * | 3/2004 | Azzola | H01H 9/282 200/50.01 |
| 2008/0149467 | A1 | 6/2008 | Somalingayya et al. | |

* cited by examiner

INTERLOCK ARTICLE

FIELD OF THE INVENTION

The present application generally relates to an electrical panel having a plurality of circuit breaker switchers and more particularly to an interlock article which ensures that only one circuit breaker switch in a panel having multiple circuit breaker switches is active at one time.

BACKGROUND OF THE INVENTION

Reliable, consistent and predictable power is necessary in many commercial and non-commercial applications and as such, back-up power generation systems are gaining in popularity. In some situations, a main power source (such as public utility power) is connected to the electrical system of a building or facility via an electrical panel (or circuit box) that contains a plurality of switches or circuit breakers, where at least one of the plurality of switches is placed in-line with the main power source to allow for the main power to be connected to and disconnected from the building as desired. In some cases, it may be desirable to have a back-up generator (or other secondary power source) for back-up power. As such, a back-up generator may be connected to the electrical system of the building or facility via the same electrical panel (or circuit box), where another of the plurality of switches or circuit breakers is placed in-line with the back-up generator to allow for the generator to be connected to and disconnected from the building as desired. Thus, the main power source and the back-up generator source are connected to the building or facility in a parallel fashion.

This parallel connection allows for one of the parallel circuits to be disconnected while the other of the parallel circuits is connected. This parallel configuration is important because for safety and compliance reasons it is required by local building codes and national electric codes that only one source of power is connected at any one time. If both the main power source and the back-up generator power source are connected at the same time, then back feeding may occur resulting in damage to the components connected to the system, fire and/or electrocution of a worker working on the power line. As such, devices meant to prevent or limit the occurrence of multiple power sources being connected to one system at the same time have been developed and implemented in commercial and non-commercial applications.

One such device currently in use is an automatic transfer switch which is placed in-line with both the main power source and a back-up power source. The transfer switch is configured to sense when the active power source (either the main power source or back-up power source) loses power. After a predetermined amount of time following the loss of power, the transfer switch then disconnects the source that lost power and connects the source with power. For example, if a main power source loses power for a period of time, then the transfer switch will disconnect the main power source and connect the back-up power source.

Unfortunately however, some systems do not have an automatic transfer switch due to the cost of installing a permanent back-up generator and automatic transfer switch and thus, rely on portable back-up generators which typically require human intervention to switch between the public utility power source and the back-up power source. This introduction of human intervention introduces the possibility of one power source being inadvertently connected while the other power source is active and connected. This is undesirable and may result in back feeding, damage and/or death from electrocution.

SUMMARY OF THE INVENTION

The present disclosure provides an interlock article for use with an electronic circuit having a plurality of switches, such as circuit breaker switches, where the interlock article ensures that only one power source is connected to a circuit at any one time.

An interlock for a circuit breaker having a first circuit breaker switch and a second circuit breaker switch is provided wherein the interlock includes an interlock housing, a first actuator movably associated with the first circuit breaker switch, a first limiter plate, and a first handle securely associated with the first actuator and first limiter plate. The first handle is moveably associated with the interlock housing to be configurable between a first handle first configuration and a first handle second configuration. A second actuator movably associated with the second circuit breaker switch is provided and includes a second limiter plate and a second handle securely associated with the second actuator and second limiter plate. The second handle is moveably associated with the interlock housing to be configurable between a second handle first configuration and a second handle second configuration, wherein when the first handle is in the first handle first configuration, the second handle is configurable between the second handle first configuration and the second handle second configuration, and when the first handle is in the first handle second configuration, the second handle is non-movably configured in the second handle first configuration, and when the second handle is in the second handle first configuration, the first handle is configurable between the first handle first configuration and the first handle second configuration, and when the second handle is in the second handle second configuration, the first handle is non-movably configured in the first handle first configuration.

An interlock for a panel having a first switch and a second switch is provided and includes a first actuator movably associated with the first switch, a first limiter plate, and a first handle securely associated with the first actuator and the first limiter plate, wherein the first limiter plate is configurable between a first plate first configuration and a first plate second configuration. A second actuator movably associated with the second switch is also provided and includes a second limiter plate, and a second handle securely associated with the second actuator and the second limiter plate, wherein the second limiter plate is configurable between a second plate first configuration and a second plate second configuration, wherein when the first limiter plate is in the first plate second configuration, the second limiter plate is non-movably configured in the second plate first configuration, and when the second limiter plate is in the second plate second configuration, the first limiter plate is non-movably configured in the first plate first configuration.

BRIEF DESCRIPTION OF THE DRAWINGS

The foregoing and other features and advantages of the present invention will be better understood from the following detailed description of illustrative embodiments, taken in conjunction with the accompanying drawings in which.

DETAILED DESCRIPTION OF THE INVENTION

In accordance with the present invention, an interlock article for use with a circuit box having circuit breakers used for multiple power inputs is provided and described herein, wherein the interlock article allows only one power source to be connected to the system at any one time. Generally, the invention includes a plurality of handles (one for each circuit breaker), where the handle is connected to a drive shaft. The drive shaft is supported by a bracket which acts as a pivot point and which is attached to the structure of the panel. An actuator is attached to the drive shaft such that when the drive shaft rotates, the actuator causes the switch arm of the circuit breaker to be configured between positions. For example, movement of the handle between a first and second position causes the switch arm of the circuit breaker to be configured between the on and off positions.

The invention also includes a limiter plate associated with the drive shaft of each handle, wherein the limiter plate is configured such that the limiter plate of one handle interacts with the limiter plate of the adjacent handle. For example, when one handle is in the off position, the associated limiter plate does not interact with the limiter plate of the adjacent handle and allows the adjacent switching apparatus to be configured between the on and off configuration. However, when the handle is in the on position, the associated limiter plate interacts with the limiter plate of the adjacent handle and prevents the adjacent switching apparatus from being configured into the on configuration.

It should be appreciated that although the present invention is disclosed herein with reference to two circuit breaker switches, it is contemplated that the scope of the invention covers two or more circuit breaker switches.

Figure 1:
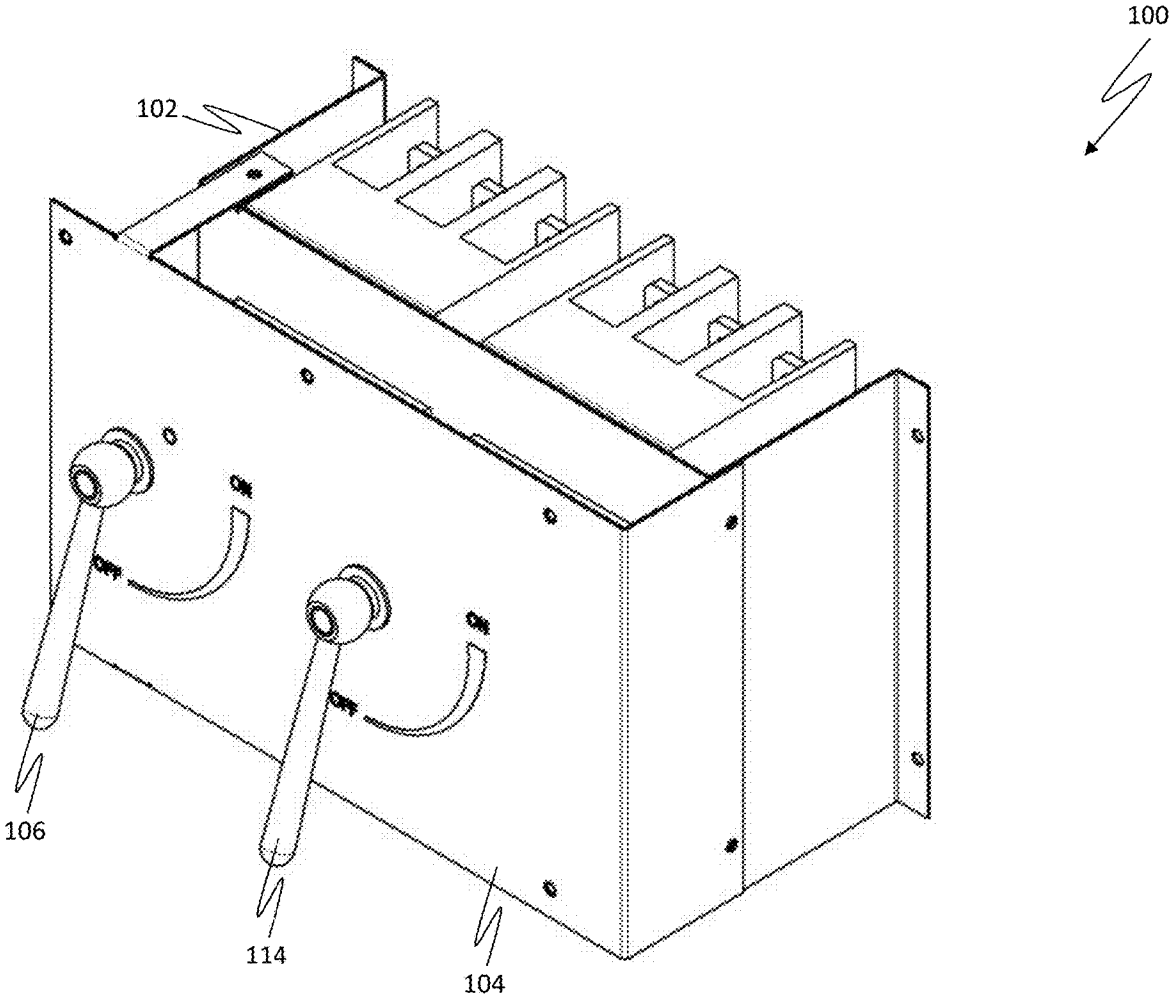
FIG. 1 is a top side isometric view of an interlock article associated with a circuit breaker box having two circuit breaker switches with the first and second interlock handles configured in the first configuration, in accordance with one embodiment of the invention.
Figure 2:
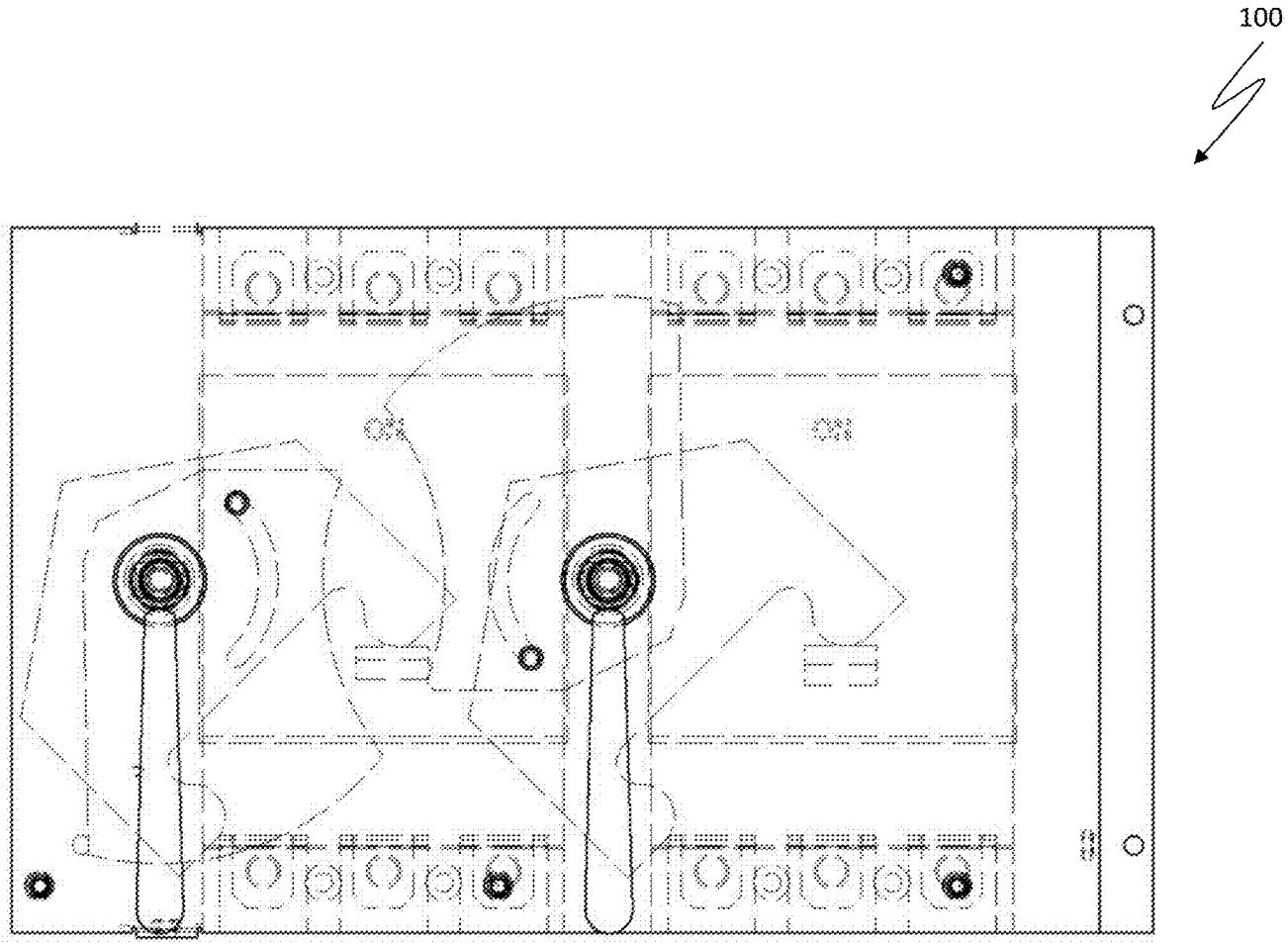
FIG. 2 is a front sectional view of the interlock article of FIG. 1.
Figure 3:
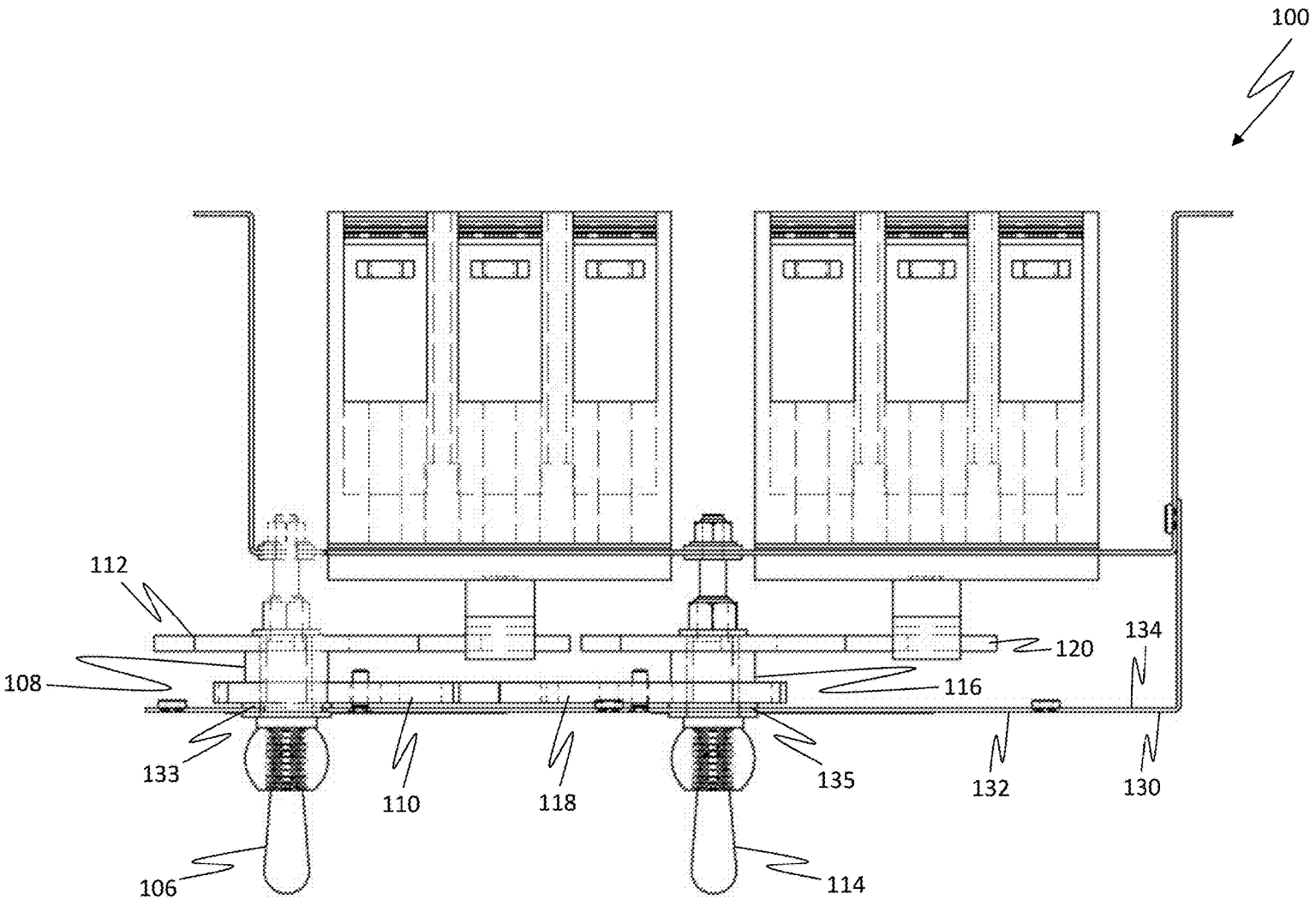
FIG. 3 is a top down view of the interlock article of FIG. 1.
Figure 4:
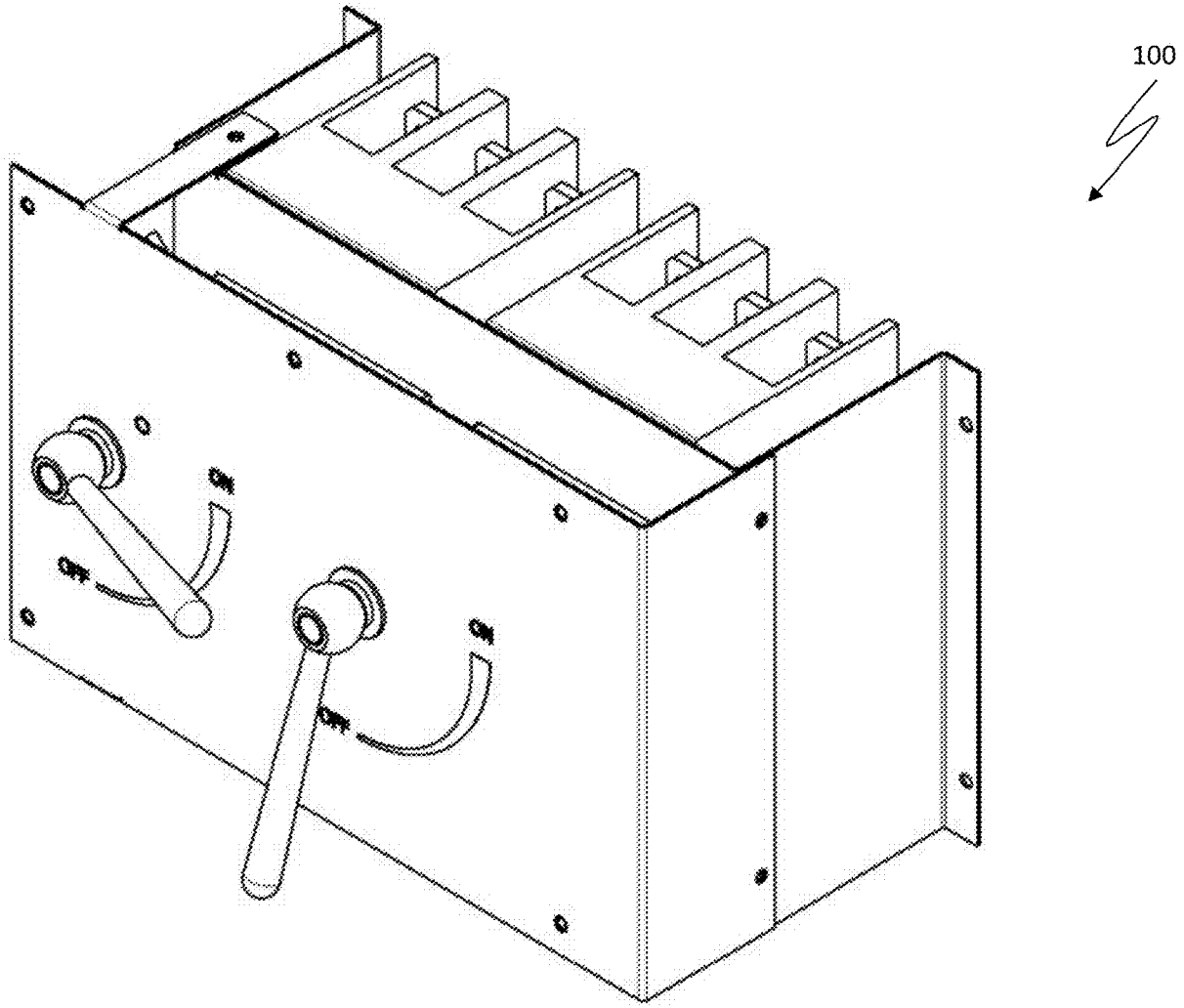
FIG. 4 is a top side isometric view of the interlock article of FIG. 1 with the first interlock handle configured in the second configuration and the second interlock handle configured in the first configuration.
Figure 5:
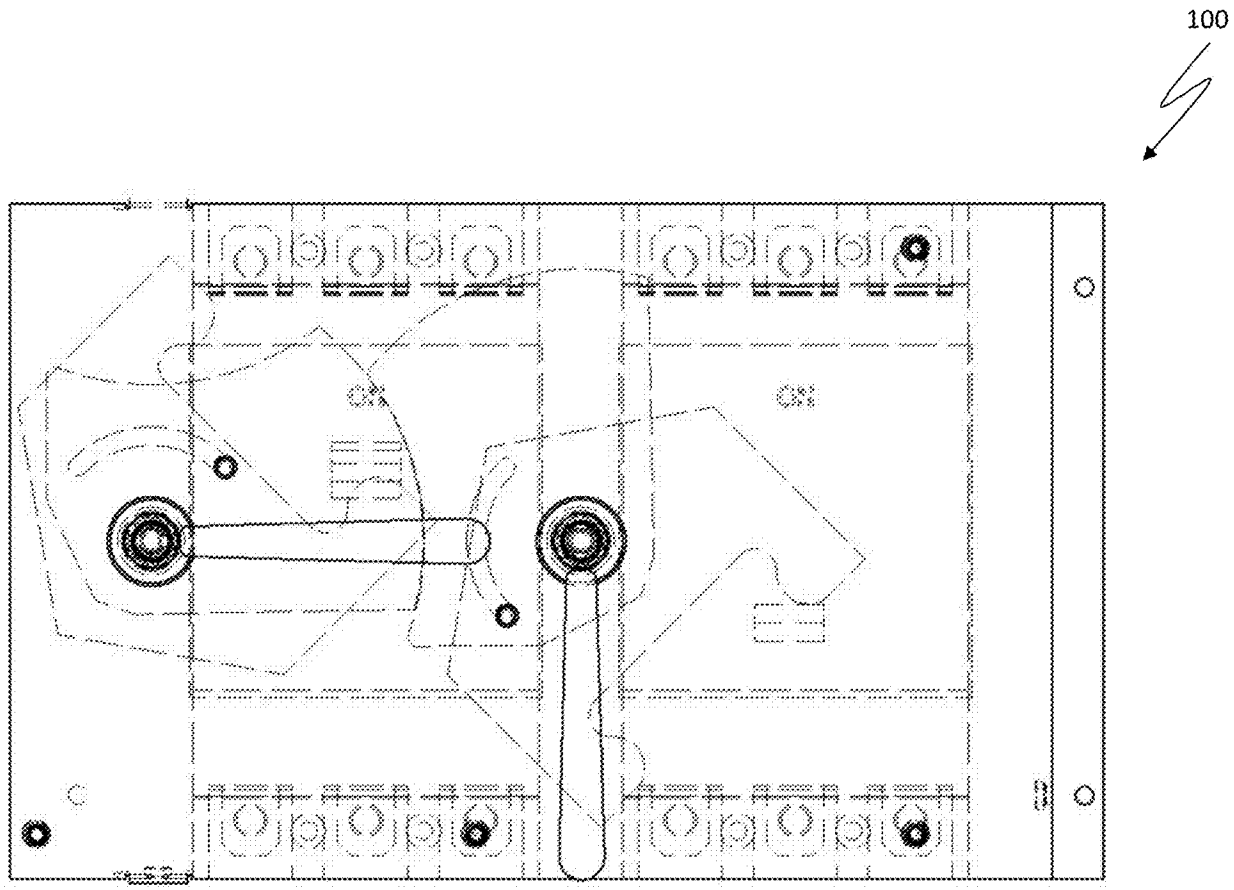
FIG. 5 is a front sectional view of the interlock article of FIG. 4.
Figure 6:
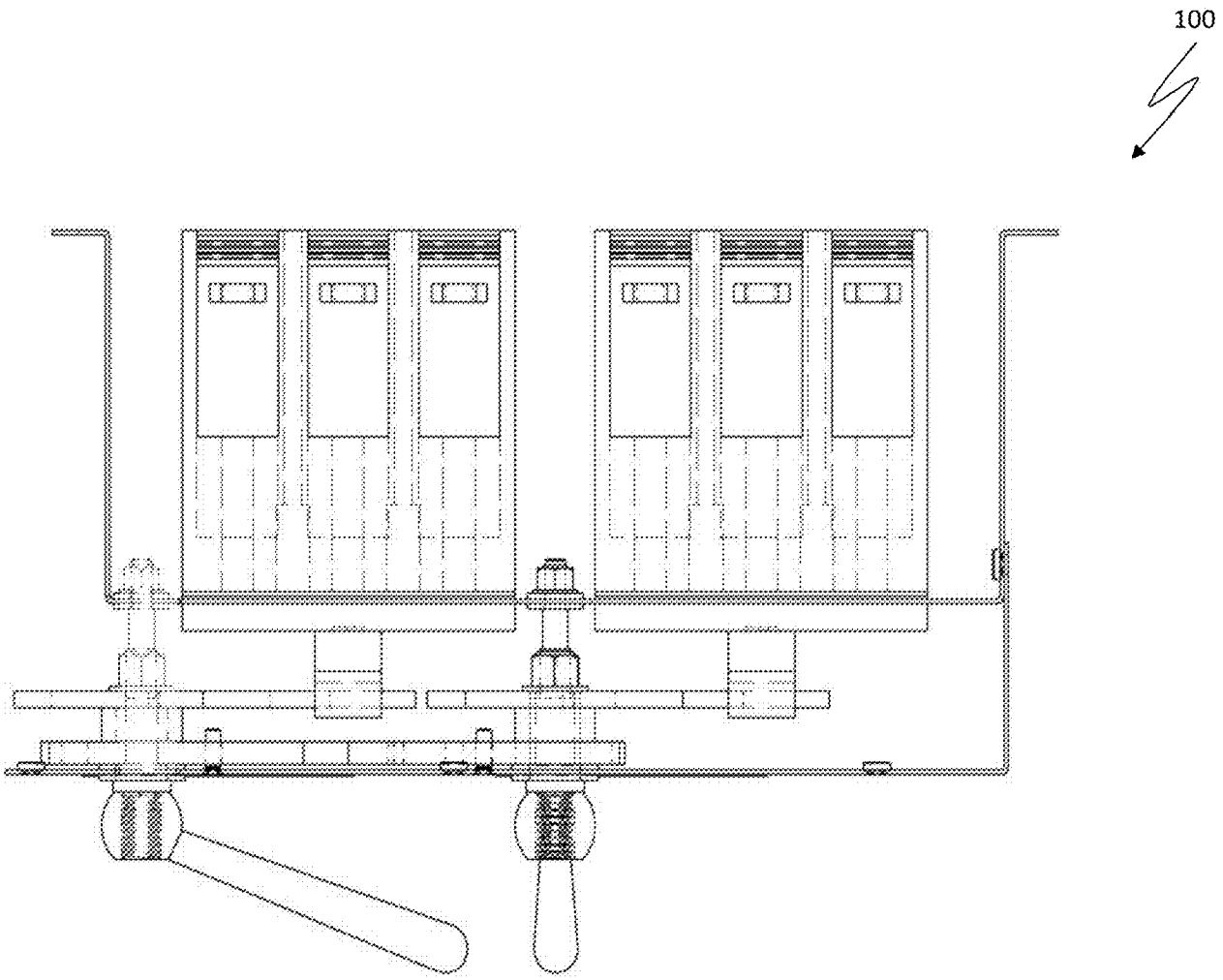
FIG. 6 is a top down view of the interlock article of FIG. 4.
Figure 7:
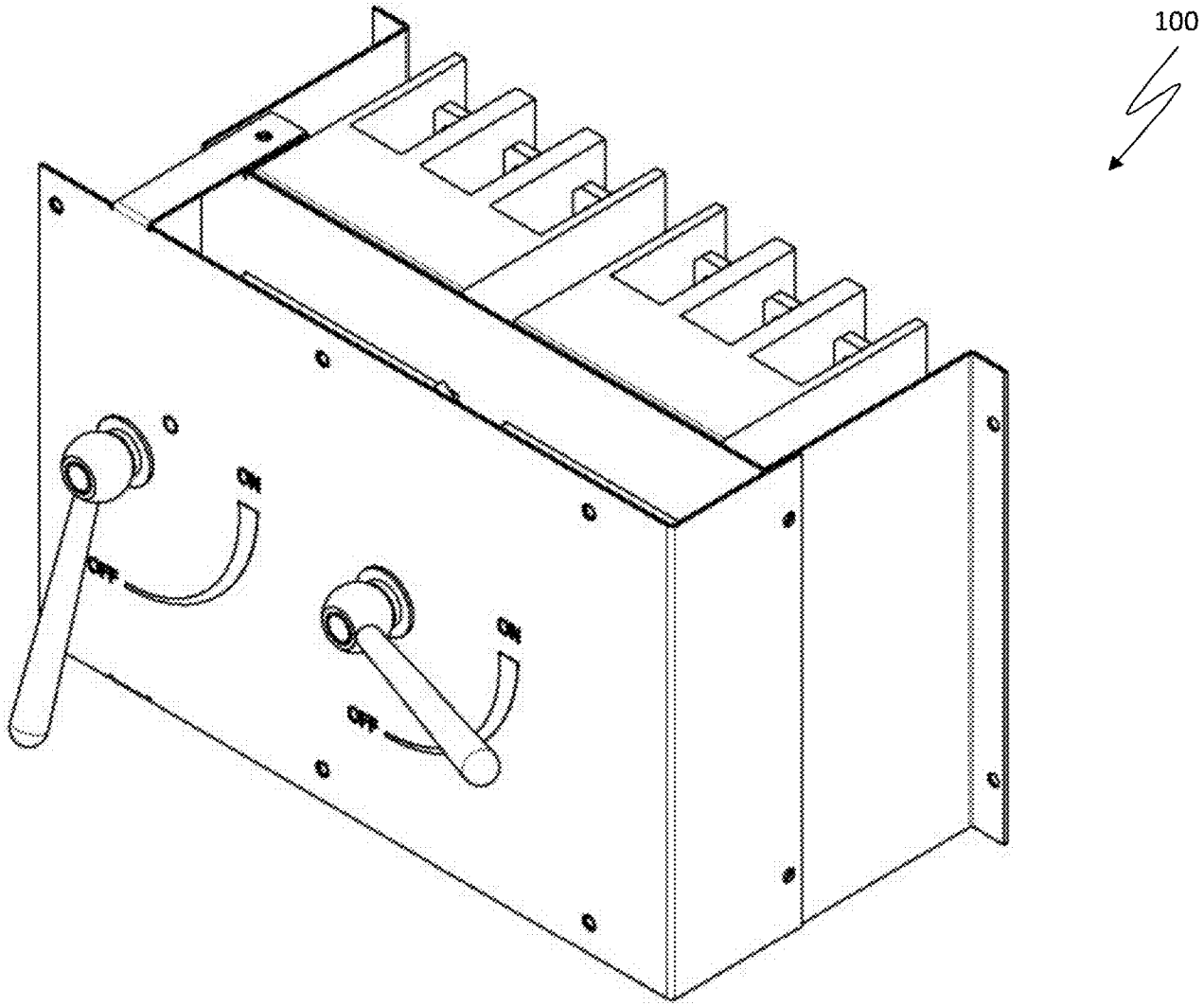
FIG. 7 is a top side isometric view of the interlock article of FIG. 1 with the first interlock handle configured in the first configuration and the second interlock handle configured in the second configuration.
Figure 8:
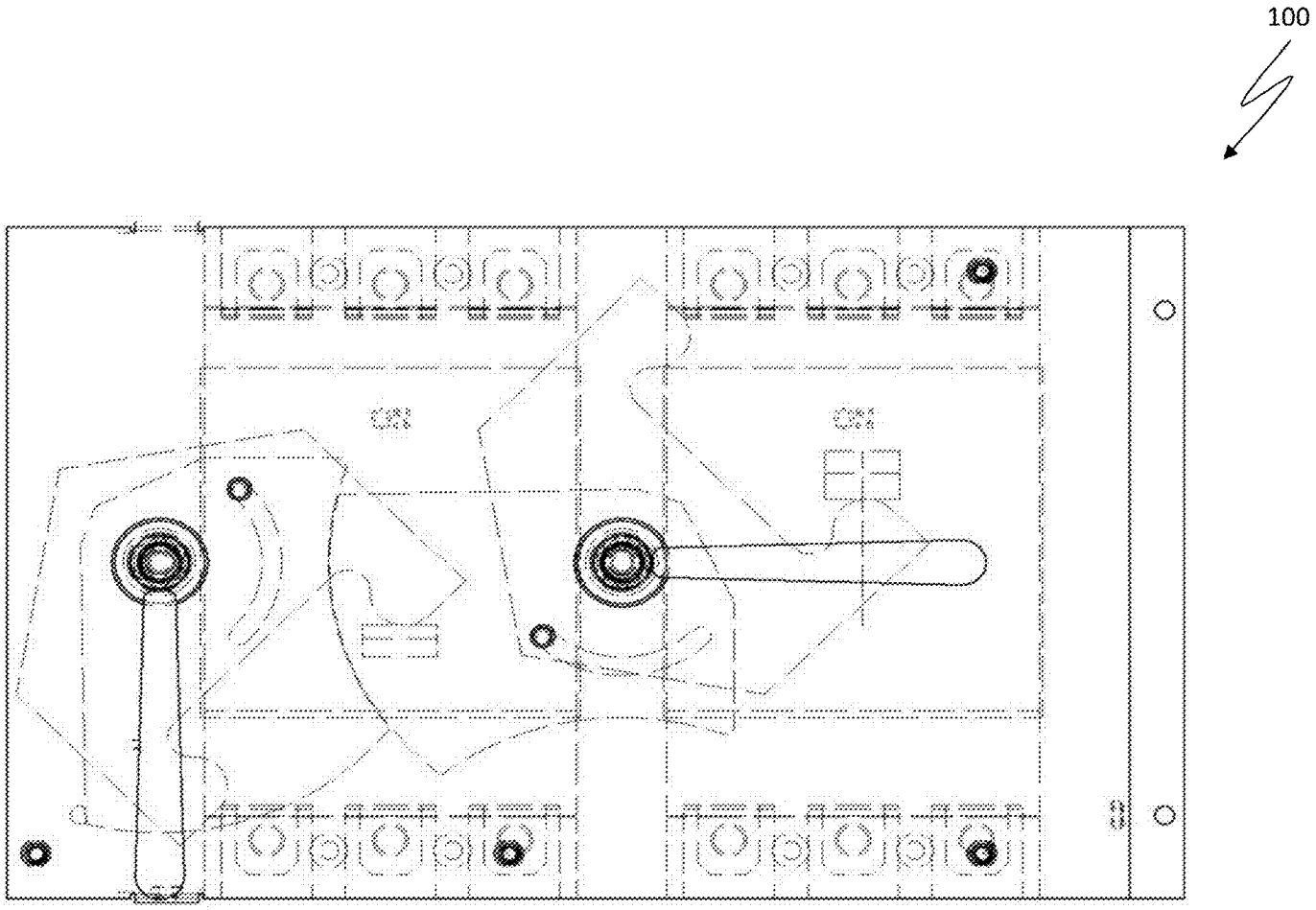
FIG. 8 is a front sectional view of the interlock article of FIG. 7.
Figure 9:
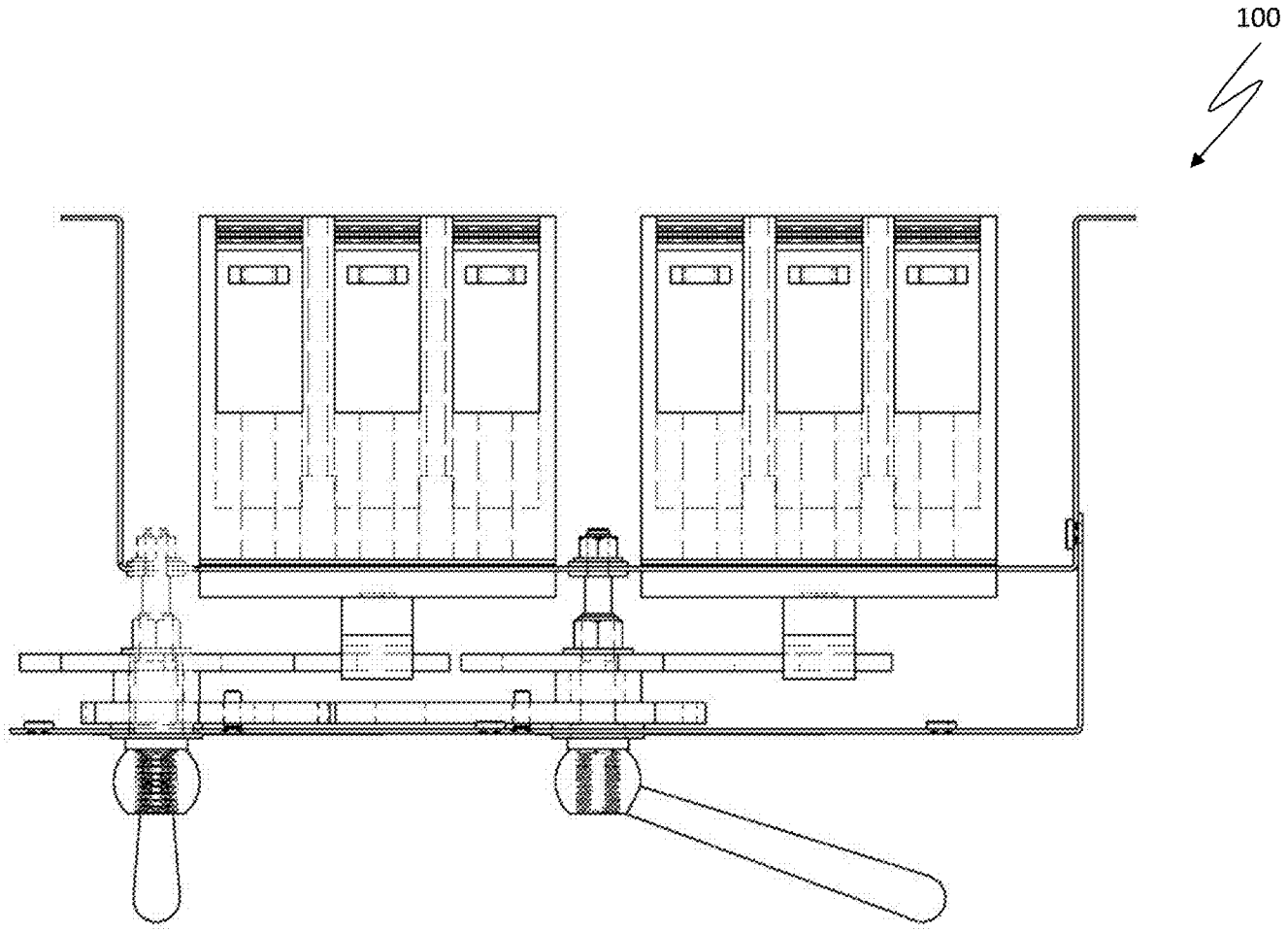
FIG. 9 is a top down view of the interlock article of FIG. 7.
Figure 10:
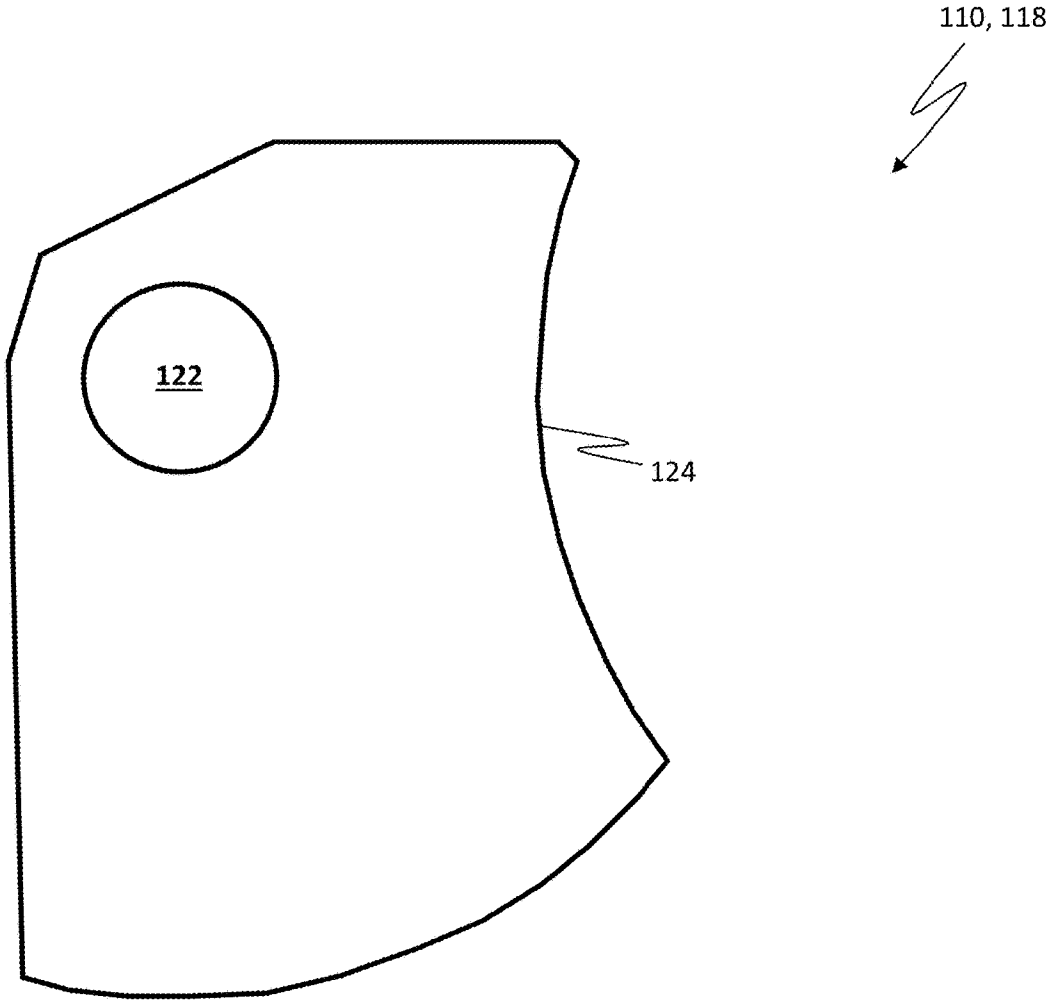
FIG. 10 is a front view of a first and second limiter plate for use with the interlock article of FIG. 1.
Figure 14:
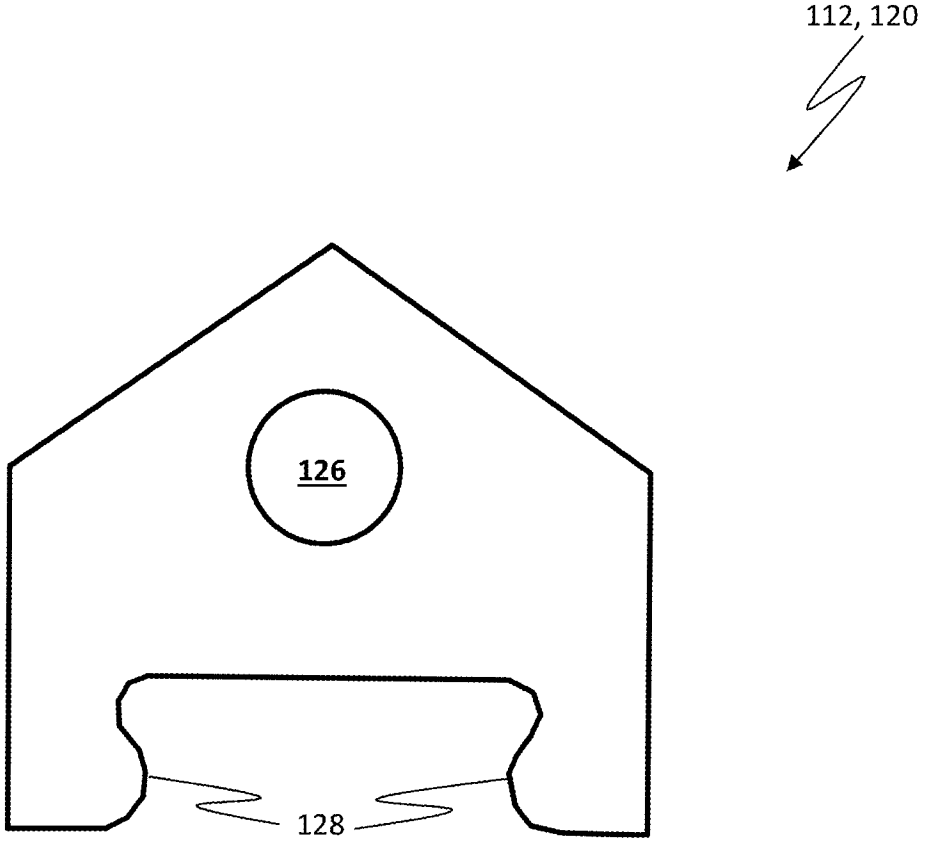
FIG. 14 is a front view of a first and second actuator for use with the interlock article of FIG. 1.

Referring to FIGS. 1-17, an interlock article 100 in accordance with one embodiment of the invention is provided and includes breaker housing 102, an interlock switch support plate 104, a first interlock handle 106, a first handle drive shaft 108, a first limiter plate 110, a first actuator 112, a second interlock handle 114, a second handle drive shaft 116, a second limiter plate 118 and a second actuator 120. Referring to FIG. 10, each of the first limiter plate 110 and second limiter plate 118 define a limiter plate shaft cavity 122 and include plate interface surface 124, wherein the limiter plate shaft cavity 122 is configured to securely associate with the handle drive shaft 108, 116 and wherein the plate interface surface 124 of the first and second limiter plates 110, 118 are configured to interact with each other as described hereinafter. Referring to FIG. 14, each of the first actuator 112 and second actuator 120 define an actuator plate cavity 126 and a circuit switch interface surface 128, wherein the actuator plate shaft cavity 126 is configured to securely associate with the handle drive shaft 108, 116 and wherein the circuit switch interface surface 128 is configured to interact with a circuit breaker switch as described hereinafter. Furthermore, referring again to FIG. 3, the interlock switch support plate 104 includes a front panel 130 having a front surface 132 and a rear surface 134, wherein the front panel 130 defines a first handle cavity 133 and a second handle cavity 135.

Referring to the FIGS., the first interlock handle 106 is securely and non-movably associated with the first handle drive shaft 108 and the first handle drive shaft 108 is located within the first handle cavity 132 such that the first handle drive shaft 108 is adjacent the front surface 132 of the housing front panel 130 and the first handle drive shaft 108 is protruding from the rear surface 134 of the housing front panel 130. Additionally, the second interlock handle 114 is securely and non-movably associated with the second handle drive shaft 116 and the second handle drive shaft 116 is located within the second handle cavity 134 such that the second handle drive shaft 116 is adjacent the front surface 132 of the housing front panel 130 and the second handle drive shaft 116 is protruding from the rear surface 134 of the housing front panel 130. It should be appreciated that the first and second handle drive shafts 108, 116 are movable relative to the housing front panel 130 so as to rotate about an imaginary axis that runs along the length of the handle drive shafts 108, 116. It should be further appreciated that the first and second handle drive shafts 108, 116 are configured to be rotatable between a first configuration (in this embodiment such that the first and second interlock handles 106, 114 are oriented to be directed vertically downward) and a second configuration (in this embodiment such that the first and second interlock handles 106, 114 are oriented to be horizontal). As explained in more detail hereinafter, in this embodiment when the first and second handle drive shafts 108, 116 are in the first configuration, the respective circuit breaker switch is in the off position and when the in the second configuration, the respective circuit breaker switch is in the on position.

Figure 11:
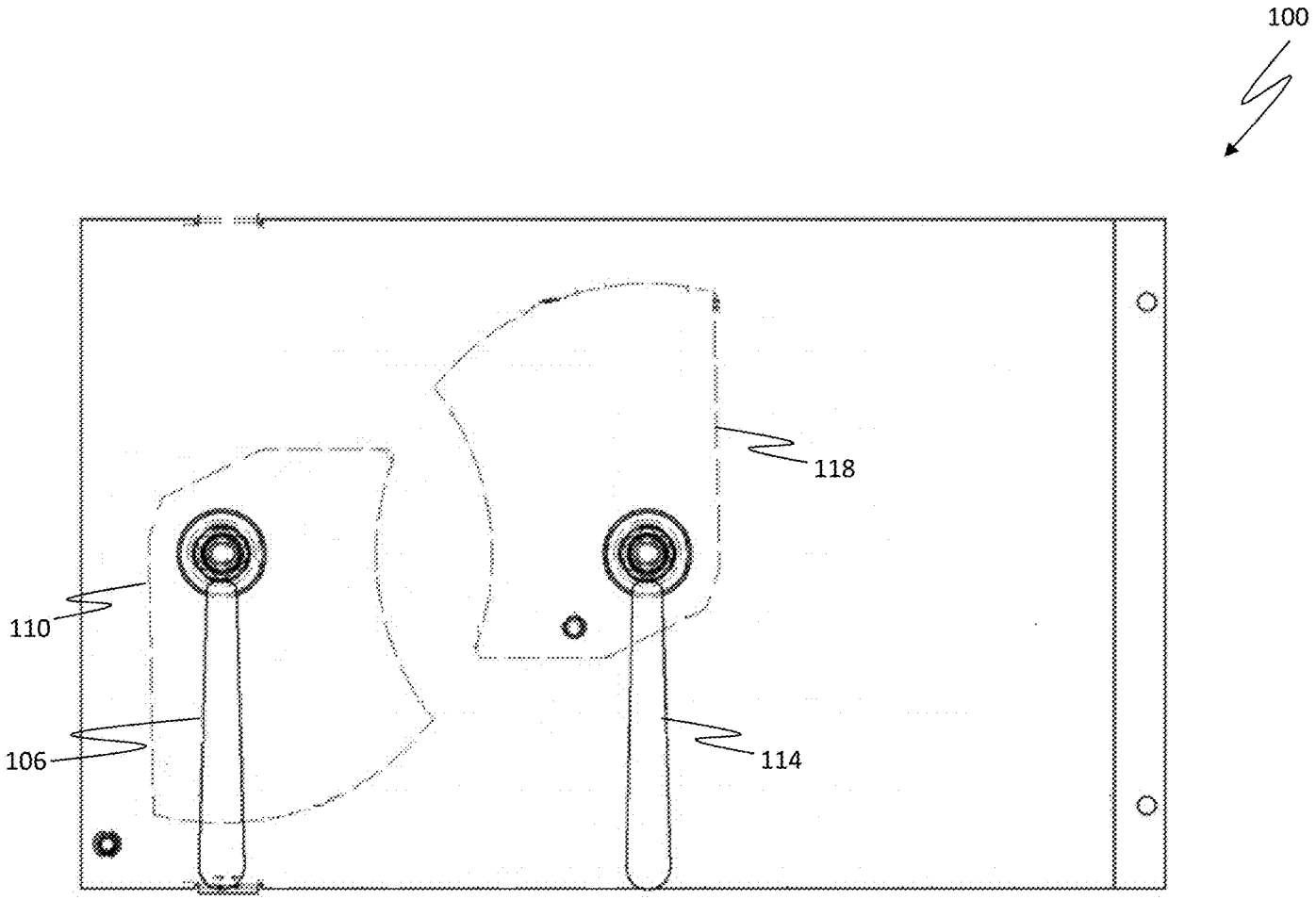
FIG. 11 is a front sectional view of the interlock article of FIG. 1 showing the orientation of the first and second limiter plates of FIG. 10 when the first and second interlock handles are configured in the first configuration.
Figure 12:
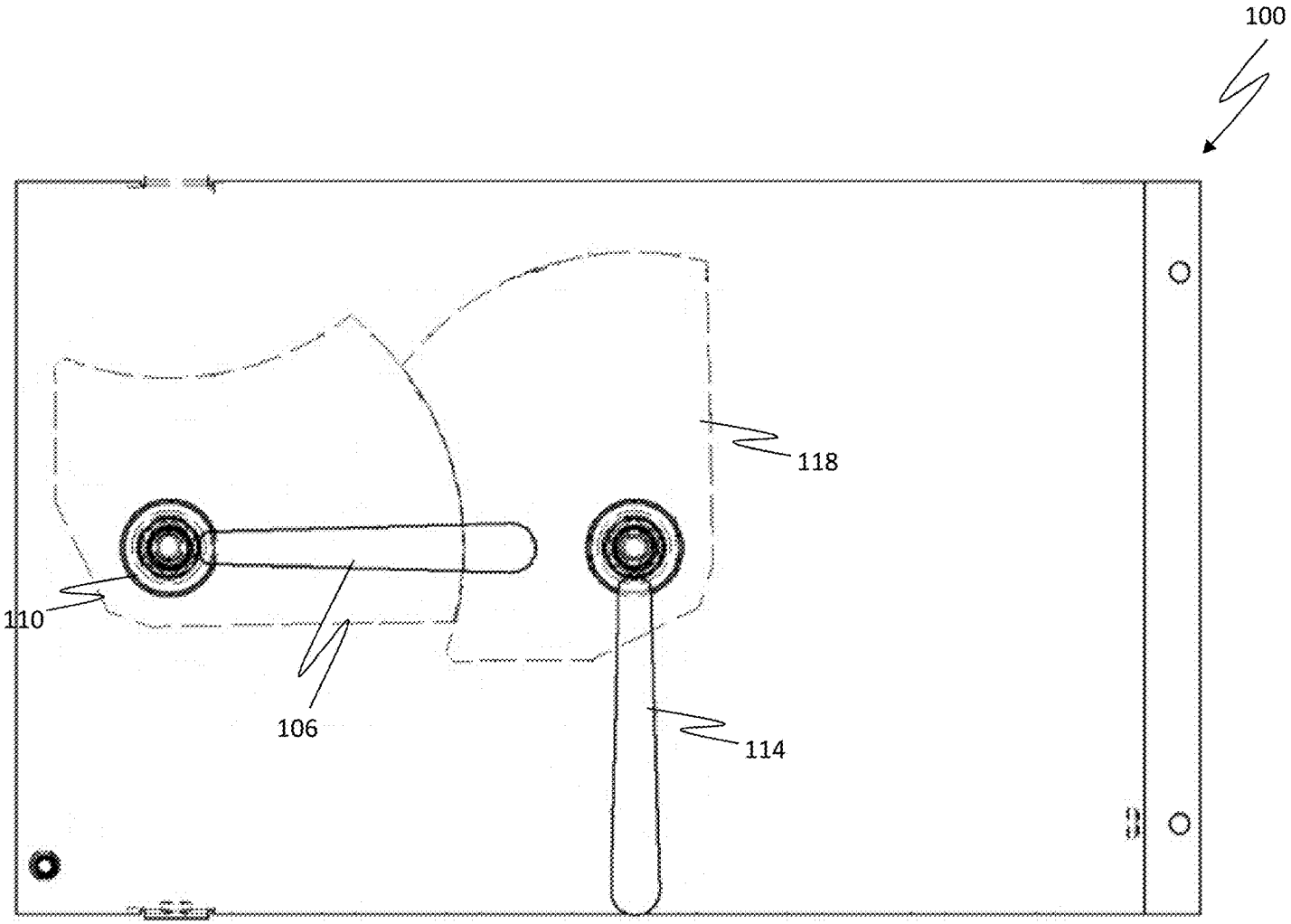
FIG. 12 is a front sectional view of the interlock article of FIG. 1 showing the orientation of the first and second limiter plates of FIG. 10 when the first interlock handle is configured in the second configuration and the second interlock handle is configured in the first configuration.
Figure 13:
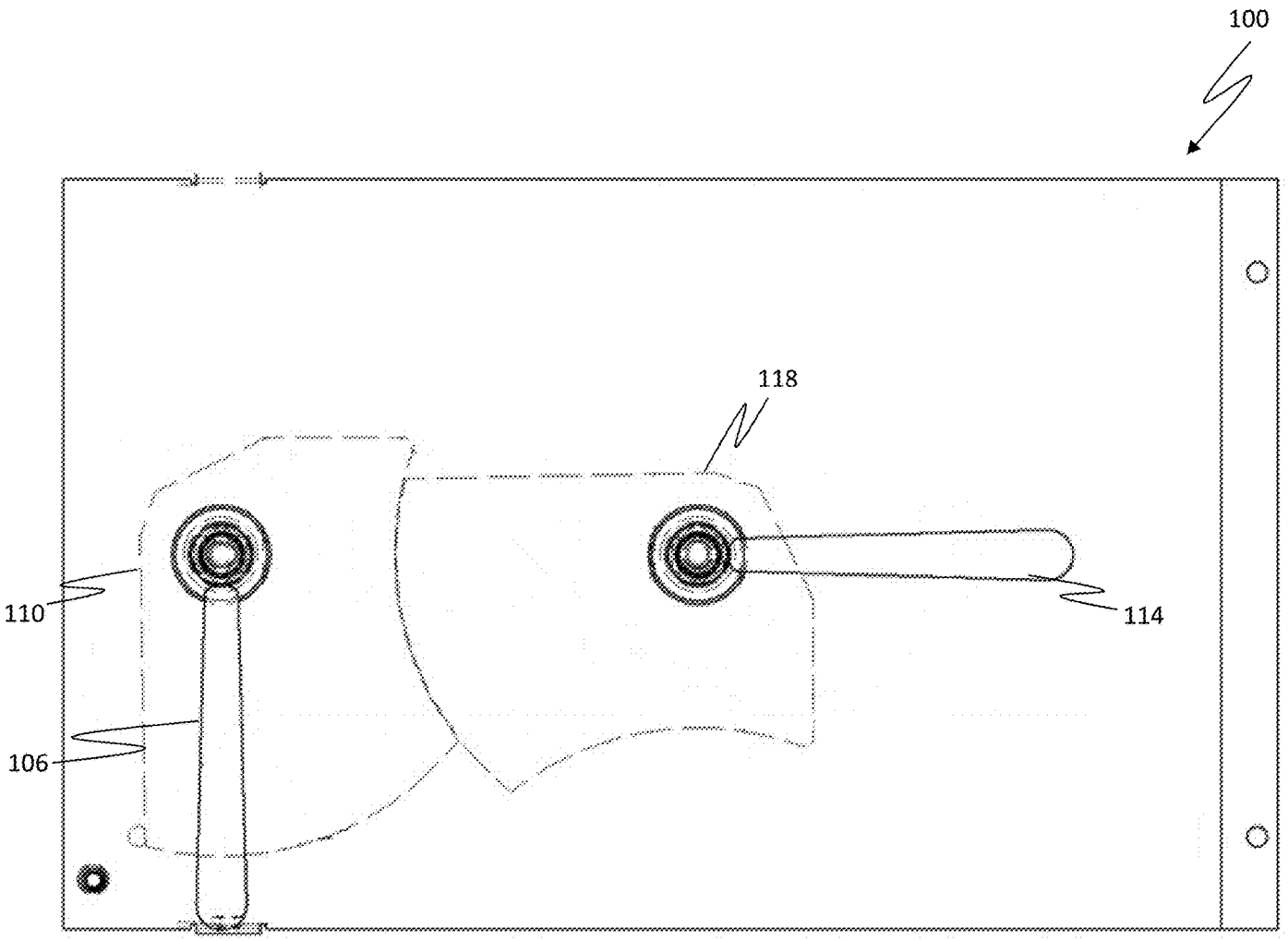
FIG. 13 is a front sectional view of the interlock article of FIG. 1 showing the orientation of the first and second limiter plates of FIG. 10 when the first interlock handle is configured in the first configuration and the second interlock handle is configured in the second configuration.
Figure 15:
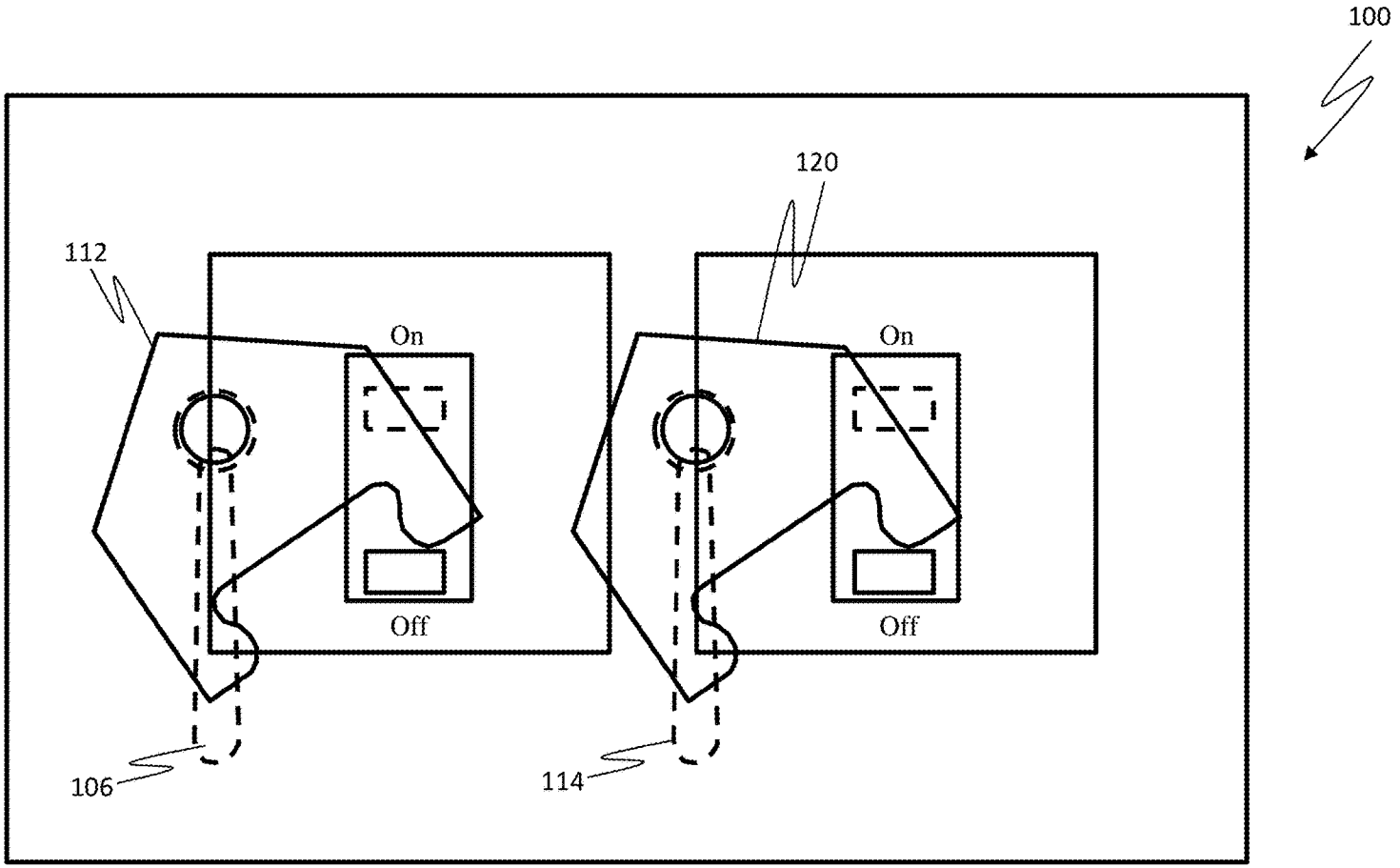
FIG. 15 is a front sectional view of the interlock article of FIG. 1 showing the orientation of the first and second actuators of FIG. 14 when the first and second interlock handles are configured in the first configuration.
Figure 16:
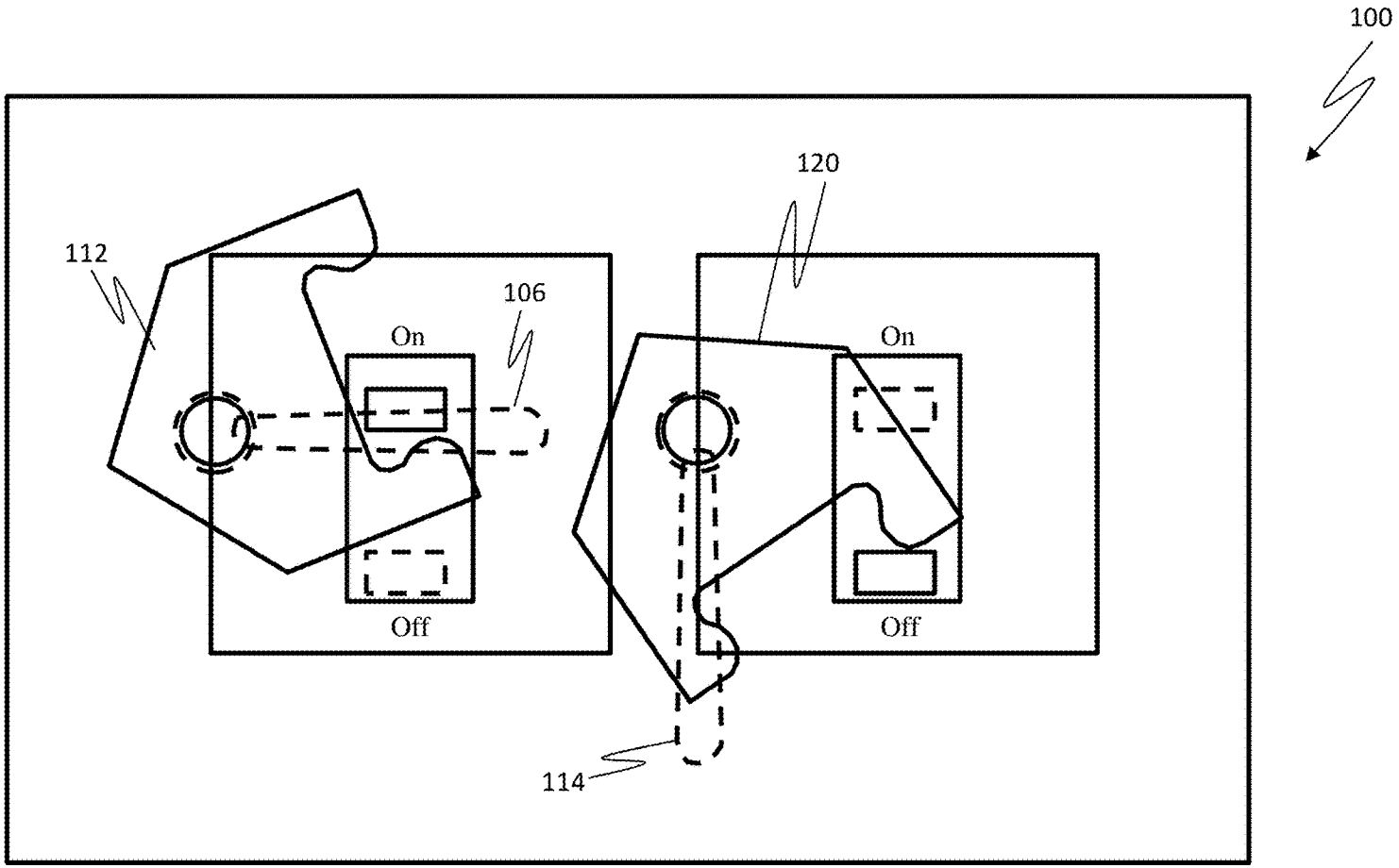
FIG. 16 is a front sectional view of the interlock article of FIG. 1 showing the orientation of the first and second actuators of FIG. 14 when the first interlock handle is configured in the second configuration and the second interlock handle is configured in the first configuration.
Figure 17:
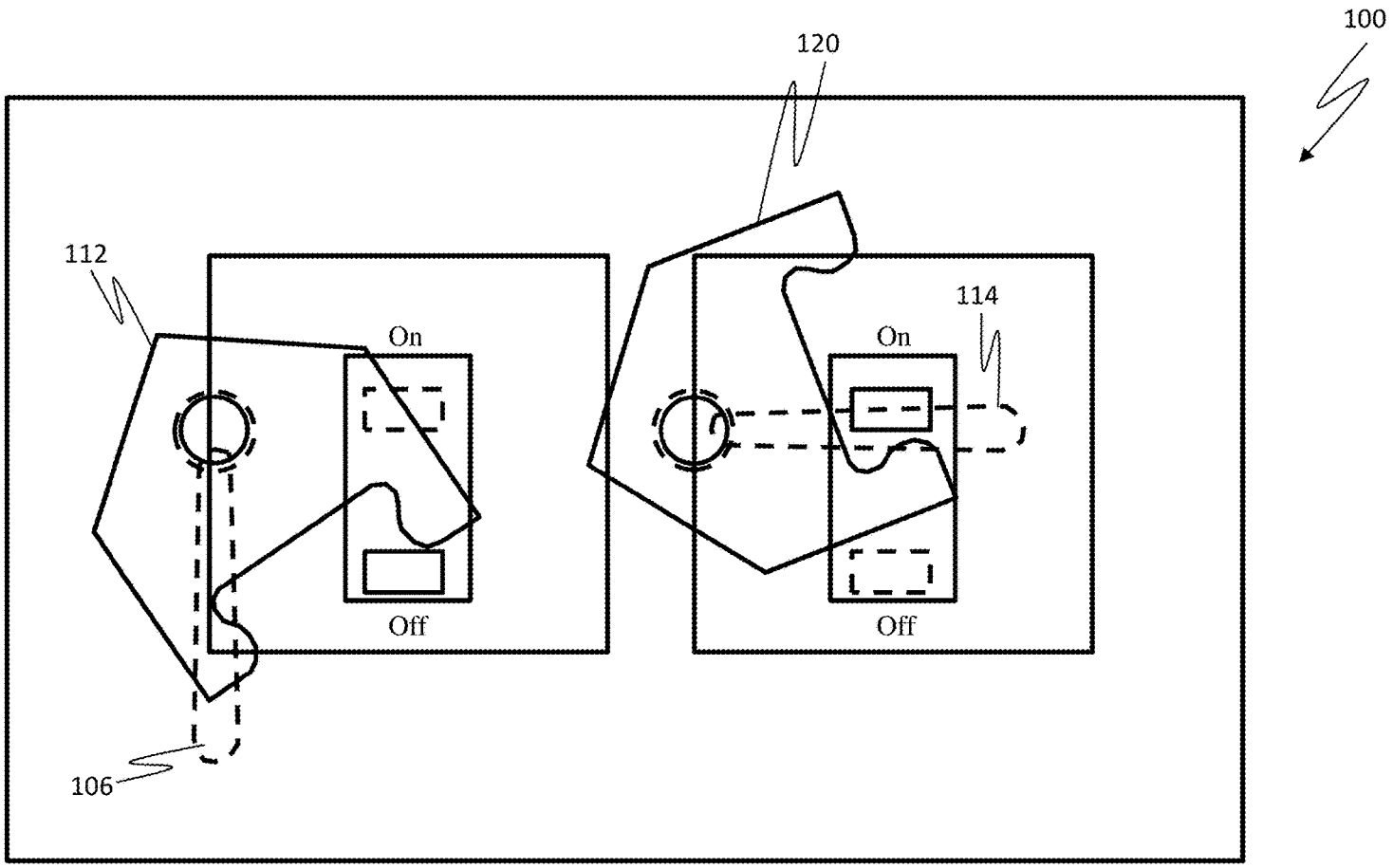
FIG. 17 is a front sectional view of the interlock article of FIG. 1 showing the orientation of the first and second actuators of FIG. 14 when the first interlock handle is configured in the first configuration and the second interlock handle is configured in the second configuration.

The first limiter plate 110 and the first actuator 112 is securely and non-movably associated with the first handle drive shaft 108 such that the first limiter plate 110 is located proximate the rear surface 134 of the housing front panel 130 and the first actuator 112 is located proximate the first limiter plate 110. Additionally, the second limiter plate 118 and the second actuator 120 is securely and non-movably associated with the second handle drive shaft 116 such that the second limiter plate 118 is located proximate the rear surface 134 of the housing front panel 130 and the second actuator 120 is located proximate the second limiter plate 118. The first limiter plate 110 and the first actuator 112 is oriented as shown in FIG. 11 and the second limiter plate 118 and the second actuator 120 is oriented as shown in FIG. 15.

The breaker housing 102 is then securely associated with a first circuit breaker switch 136 and a second circuit breaker switch 138, such that when the first interlock handle 106 is configured in the first configuration, a portion of the circuit switch interface surface 128 is located proximate the top of the first circuit breaker switch 136 and when the first interlock handle 106 is configured in the second configuration, a portion of the circuit switch interface surface 128 is located proximate the bottom of the first circuit breaker switch 136. Similarly, when the second interlock handle 114 is configured in the first configuration, a portion of the circuit switch interface surface 128 is located proximate the top of the second circuit breaker switch 138 and when the second interlock handle 114 is configured in the second configuration, a portion of the circuit switch interface surface 128 is located proximate the bottom of the first circuit breaker switch 138. It should be appreciated that when the first limiter plate 110 and the second limiter plate 118 are associated with the first handle drive shaft 108 and the second handle drive shaft 116, respectively, they are located adjacent each other such that if they are not oriented correctly, any rotation of one will cause the first and second limiter plates 110, 118 to contact each other preventing further rotation.

It should be further appreciated that the first limiter plate 110 and the second limiter plate 118 are arranged such that when the first and second interlock handles 106, 114 are in the first configuration, either one of the first and second interlock handles 106, 114 can be configured into the second configuration. If the first interlock handle 106 is configured into the second configuration, then the second interlock handle 114 must be in the first configuration. In this situation, the first limiter plate 110 will prevent the second limiter plate 118 (and thus the second interlock handle 114 and second actuator 120) from being configurable into the second configuration. Likewise, if the second interlock handle 114 is configured into the second configuration, then the first interlock handle 106 must be in the first configuration. In this situation, the second limiter plate 118 will prevent the first limiter plate 110 (and thus the first interlock handle 106 and first actuator 112) from being configurable into the second configuration. In this way, the interlock article 100 advantageously only allows one circuit breaker switch to be turned on at any one time.

Referring to FIG. 18, FIG. 19, FIG. 20 and FIG. 21, an interlock article 200 in accordance with another embodiment is provided and includes a limiter plate 202 and a limiter plate adapter 204, wherein the limiter plate 202 includes a plate interface surface 206. The limiter plate adapter 204 defines a first adapter plate interface surface 208, a second adapter plate interface surface 210 and a configurable adapter plug 212, wherein the configurable adapter plug 212 is resiliently associated with the limiter plate adapter 204 and configurable between a first adapter configuration and a second adapter configuration. When in the first adapter configuration, the configurable adapter plug 212 is located proximate to and protrudes from the first adapter plate interface surface 208 and when in the second adapter configuration, the configurable adapter plug 212 is located proximate to and protrudes from the second adapter plate interface surface 210. It should be appreciated that this limiter plate adapter 204 (when used with the limiter plate 202) allows for the interlock article 200 to be used with any number of circuit breaker switches. Two examples of this is shown in FIGS. 21-24 and in FIG. 25-29. It should be further appreciated that the interlock article 200 engages the circuit breaker switches in a manner similar to the interlock article 100 discussed hereinabove.

Figure 18:
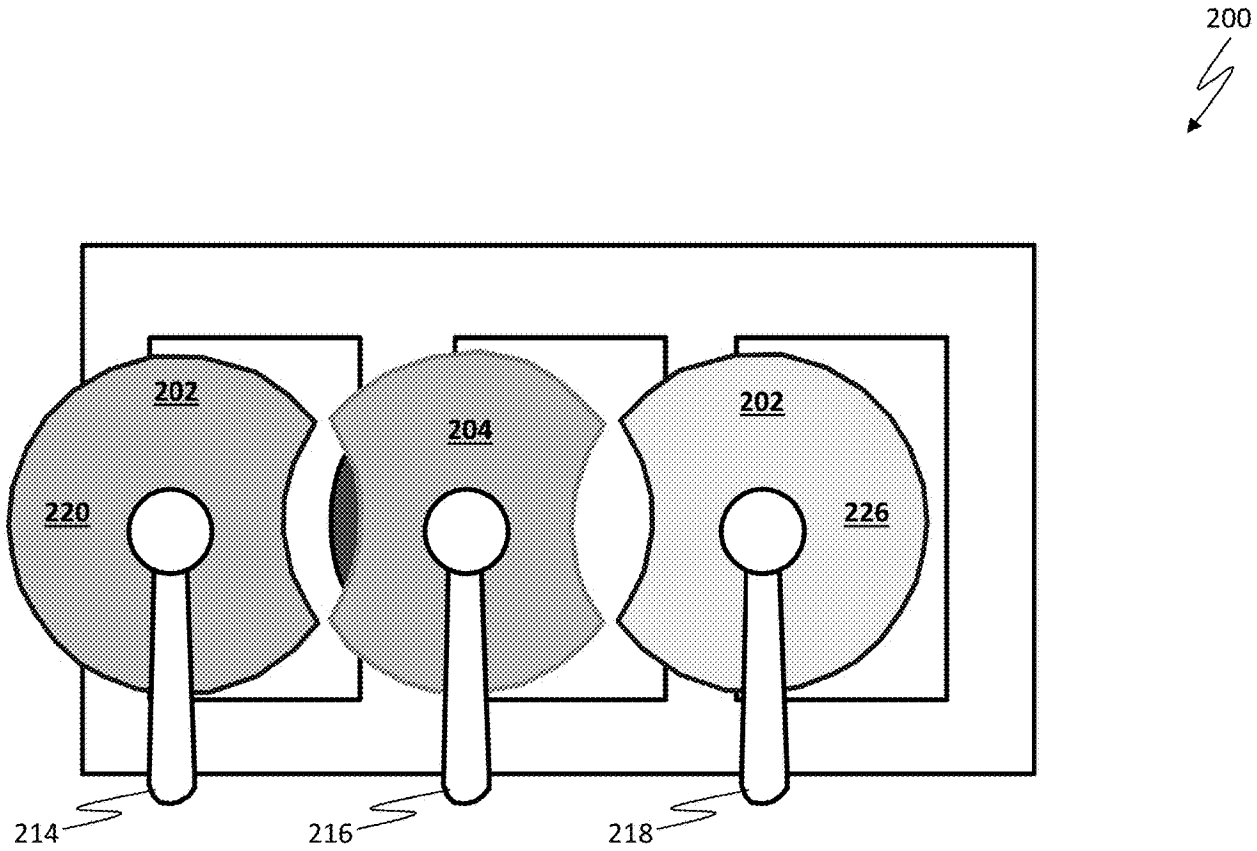
FIG. 18 is a front sectional view of an interlock article configured for use with three circuit breaker switches, in accordance with another embodiment of the invention.
Figure 19:
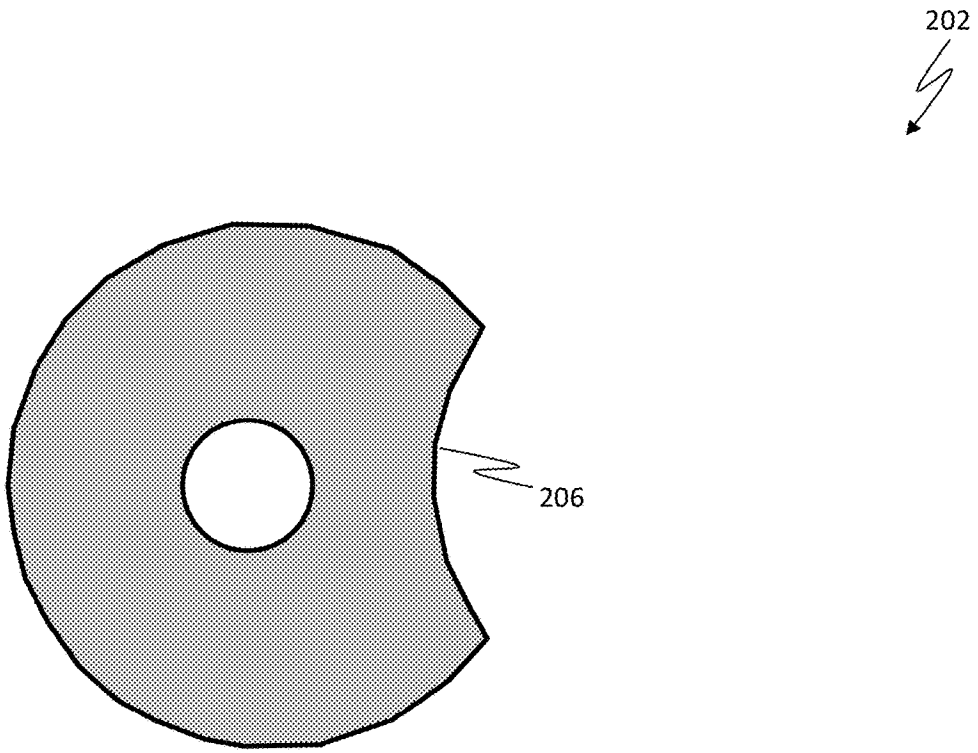
FIG. 19 is a front view of a limiter plate for use with the interlock article of FIG. 18.
Figure 20:
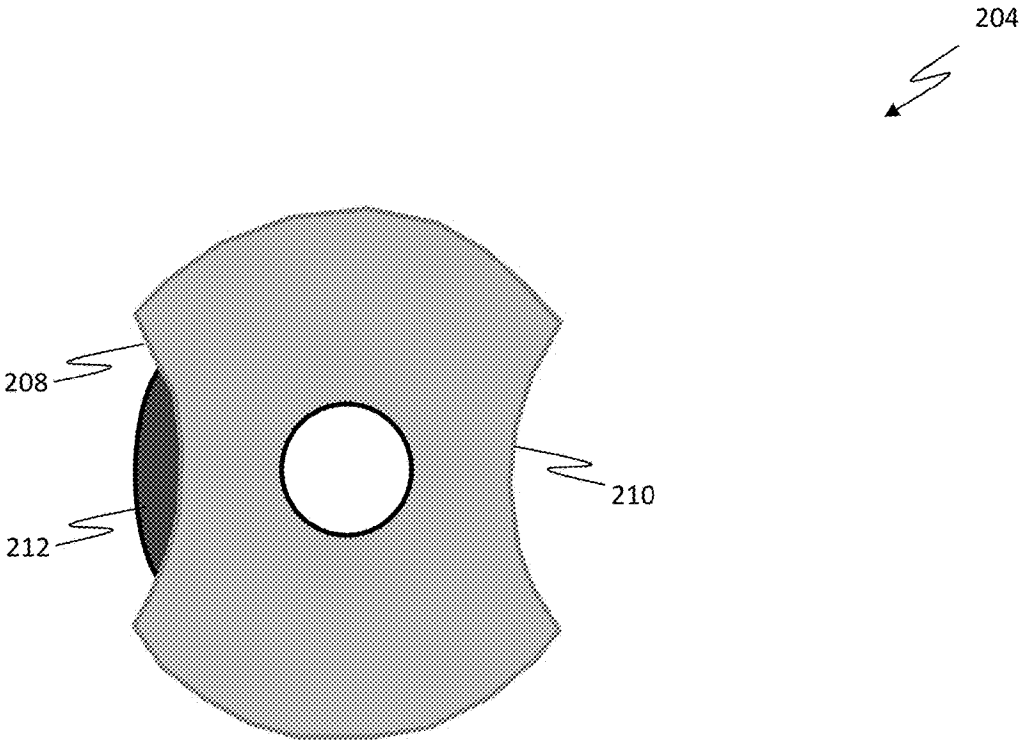
FIG. 20 is a front view of a limiter plate adapter for use with the interlock article of FIG. 18.
Figure 21:
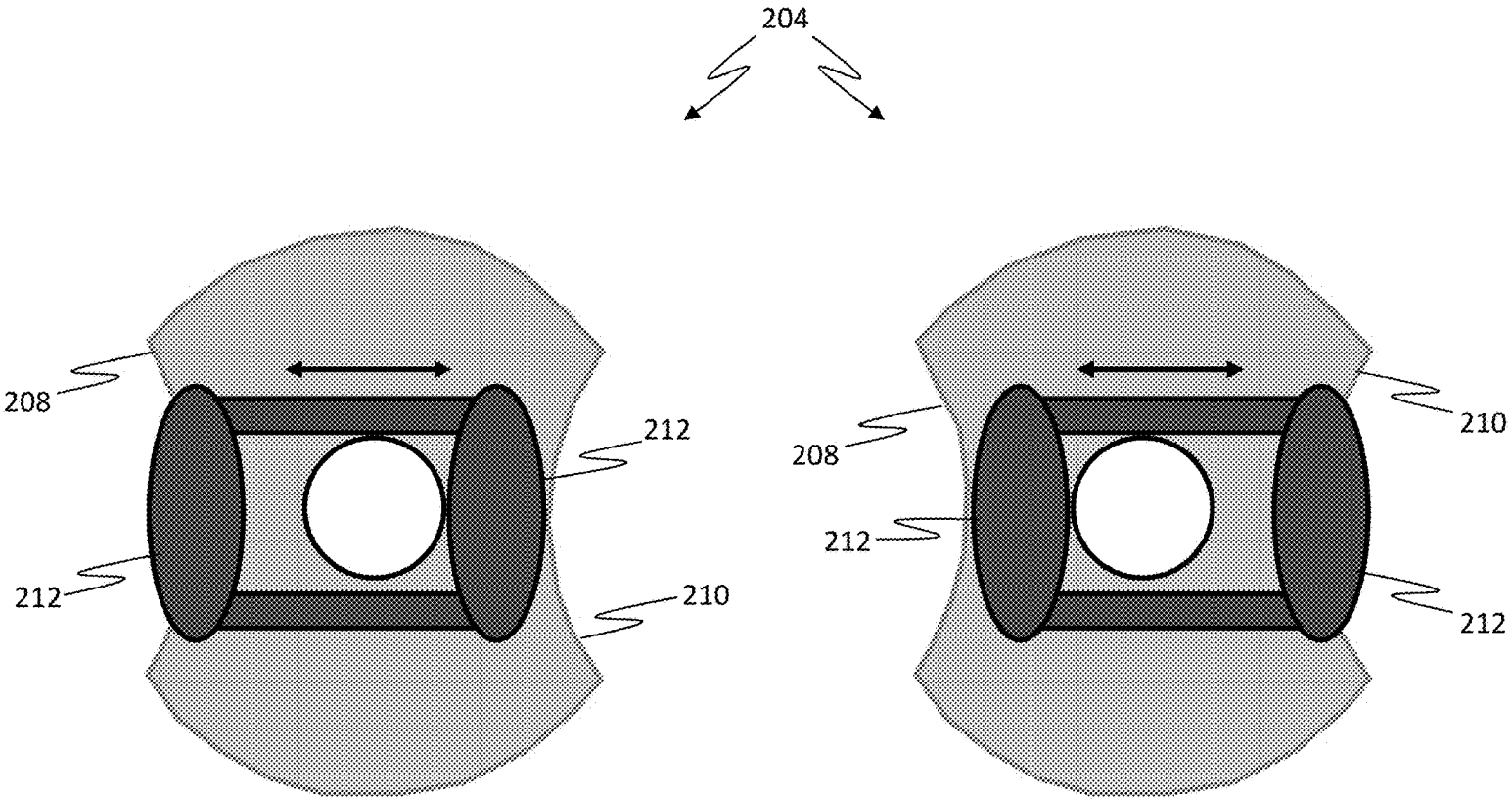
FIG. 21 is a rear view of the limiter plate adapter of FIG. 20.

Referring to FIG. 18, an interlock article 200 configured to operate with three circuit breaker switches is shown. The interlock article 200 includes a first interlock handle 214, a second interlock handle 216 and a third interlock handle 218, wherein the first interlock handle 214 is connected to a first limiter plate 220 and a first actuator, the second interlock handle 216 is connected to limiter adapter plate 204 and a second actuator and the third interlock handle 218 is connected to a second limiter plate 226 and a second actuator. Additionally, as discussed hereinbefore with regards to other embodiments, the first interlock handle 214, second interlock handle 216 and third interlock handle 218 are configurable between a first configuration and a second configuration, wherein when in the first configuration the circuit breaker switch is in the "on" position and when in the second configuration the circuit breaker switch is in the "off" position. FIG. 18 shows the first interlock handle 214, second interlock handle 216 and third interlock handle 218 configured in the first configuration.

Figure 22:
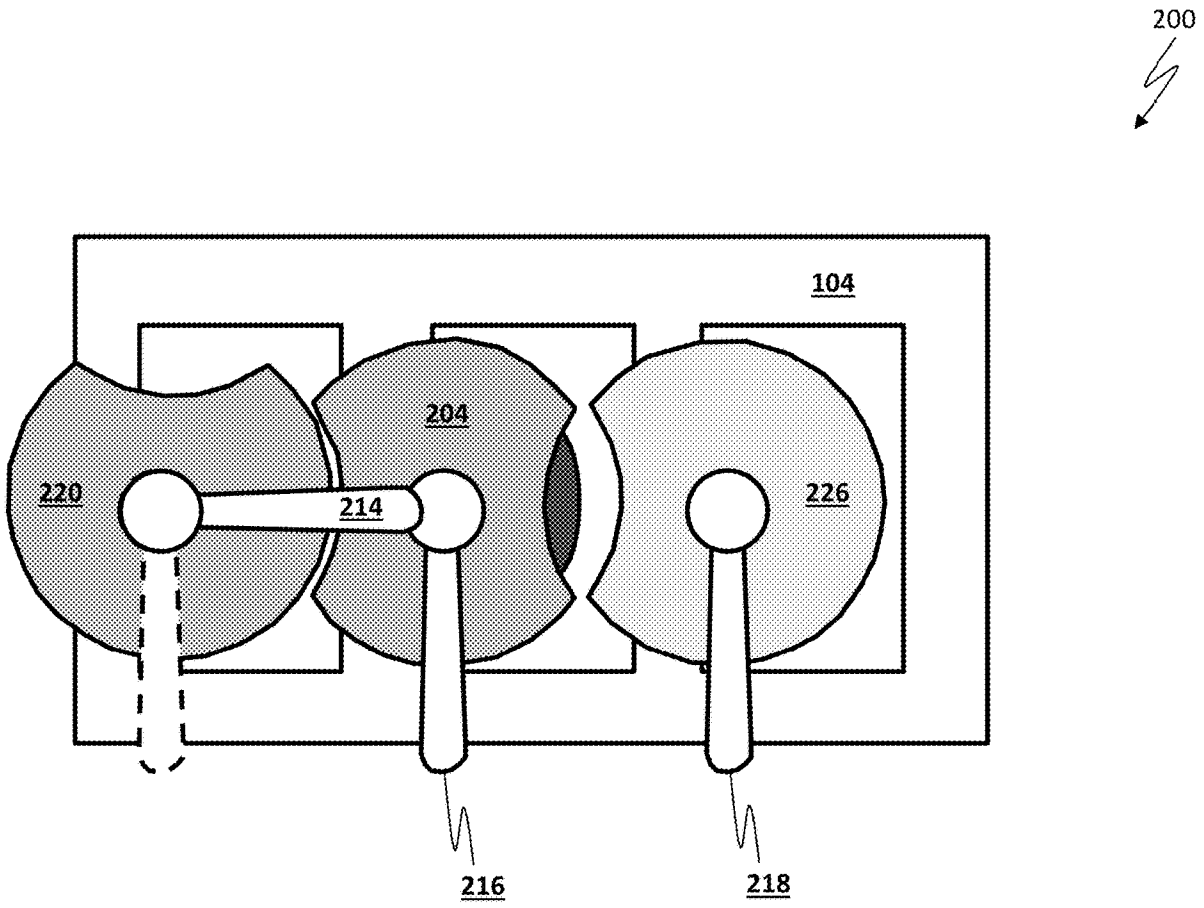
FIG. 22 is a front sectional view of the interlock article of FIG. 18 showing the orientation of the first and second limiter plates of FIG. 19 and the limiter adapter plate of FIG. 20, when the first interlock handle is configured in the second configuration and the second and third interlock handles are configured in the first configuration.
Figure 23:
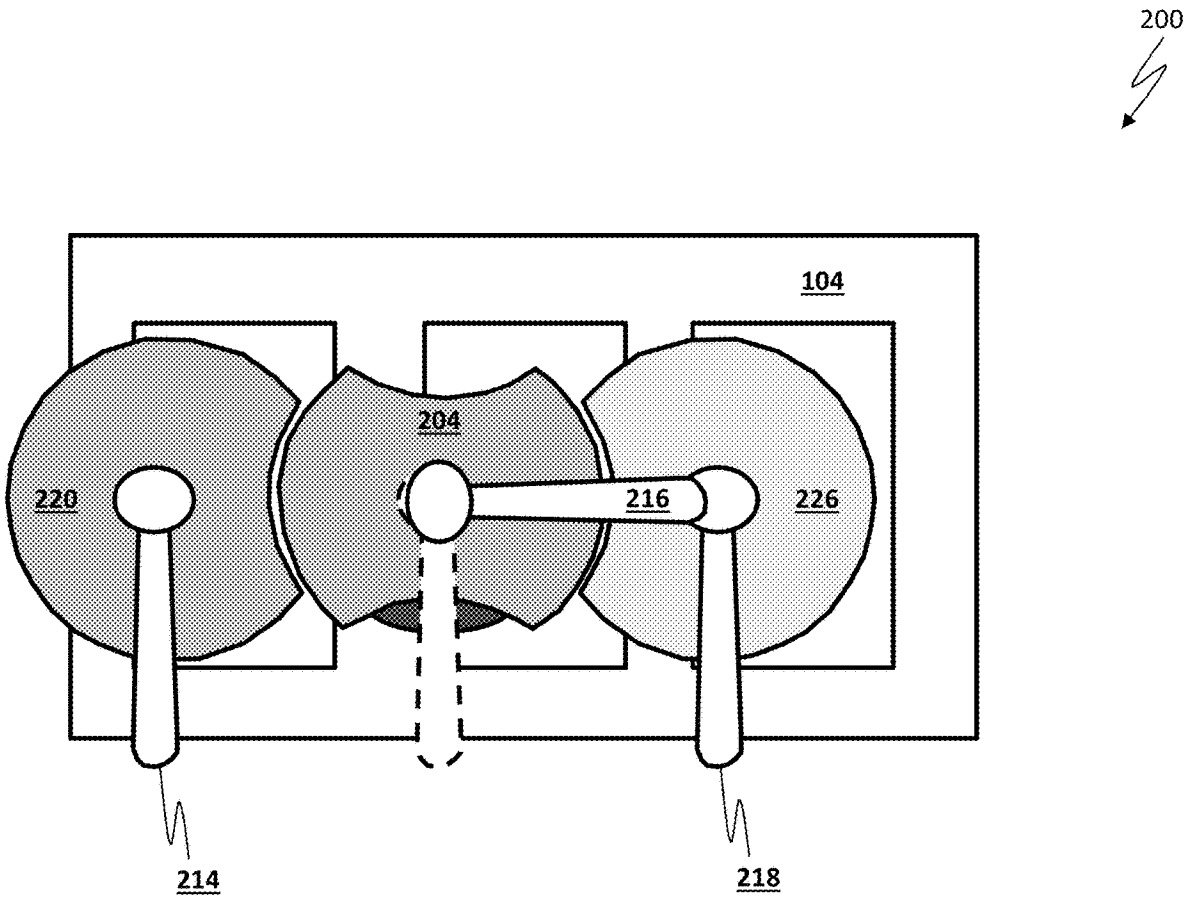
FIG. 23 is a front sectional view of the interlock article of FIG. 18 showing the orientation of the first and second limiter plates of FIG. 19 and the limiter adapter plate of FIG. 20, when the second interlock handle is configured in the second configuration and the first and third interlock handles are configured in the first configuration.
Figure 24:
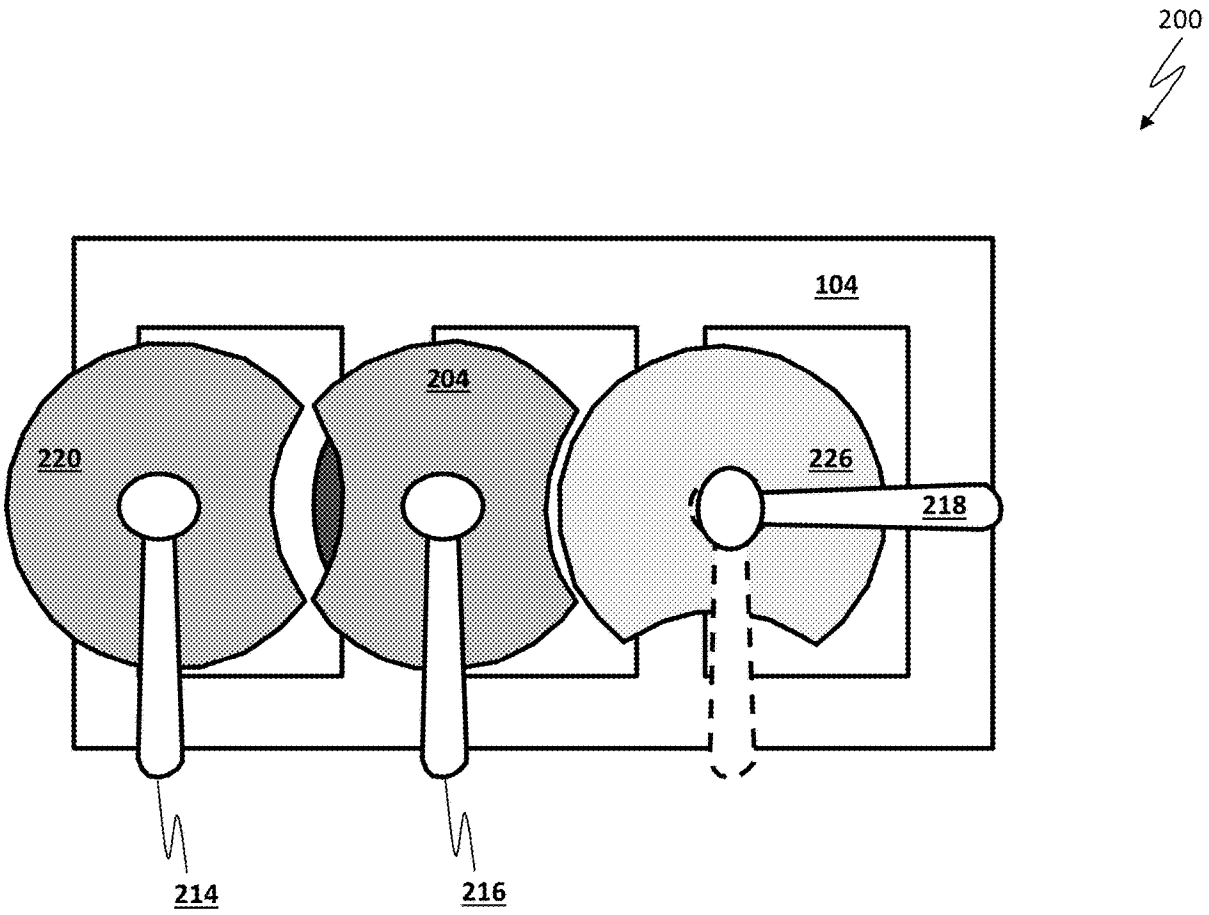
FIG. 24 is a front sectional view of the interlock article of FIG. 18 showing the orientation of the first and second limiter plates of FIG. 19 and the limiter adapter plate of FIG. 20, when the third interlock handle is configured in the second configuration and the first and second interlock handles are configured in the first configuration.
Figure 25:
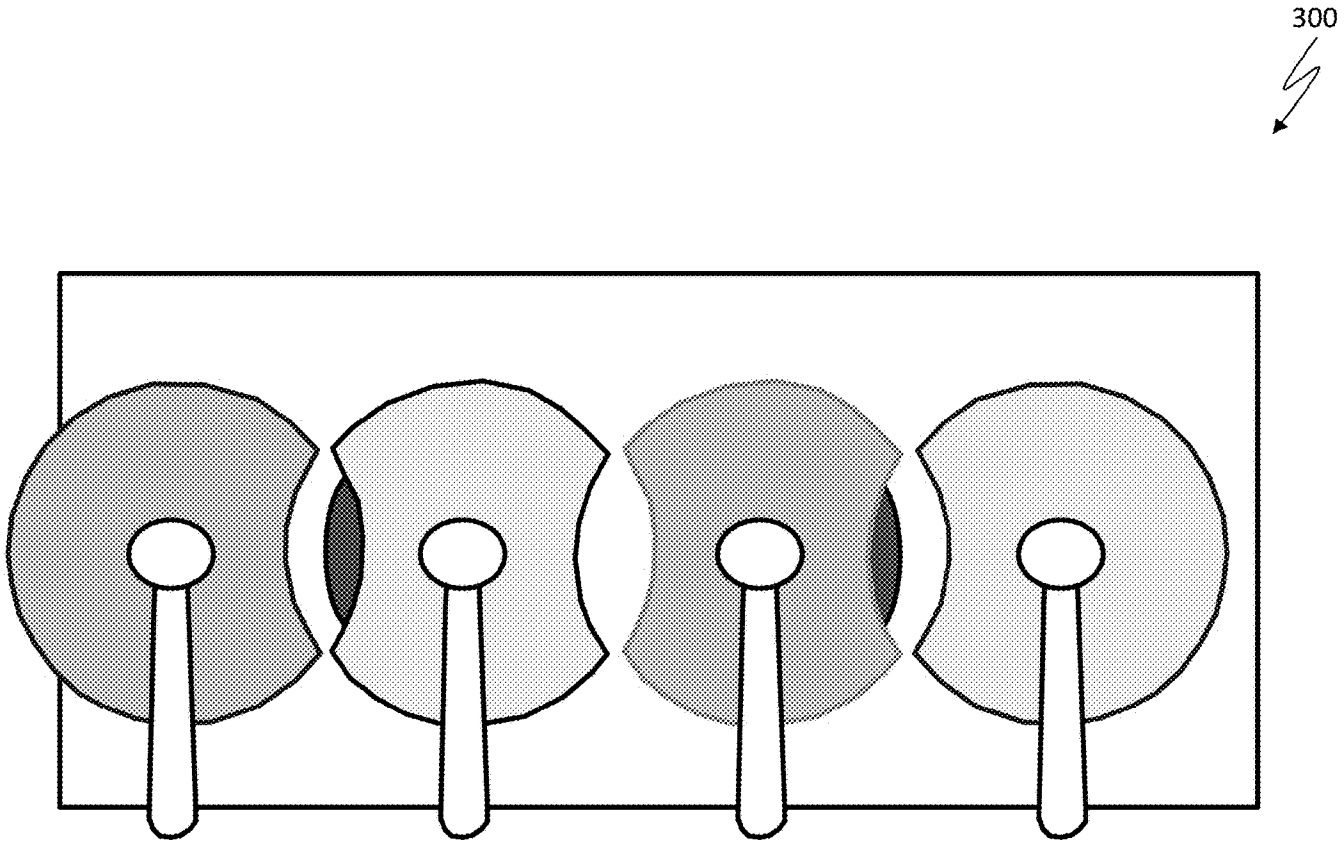
FIG. 25 is a front sectional view of an interlock article configured for use with four circuit breaker switches, in accordance with another embodiment of the invention.
Figure 26:
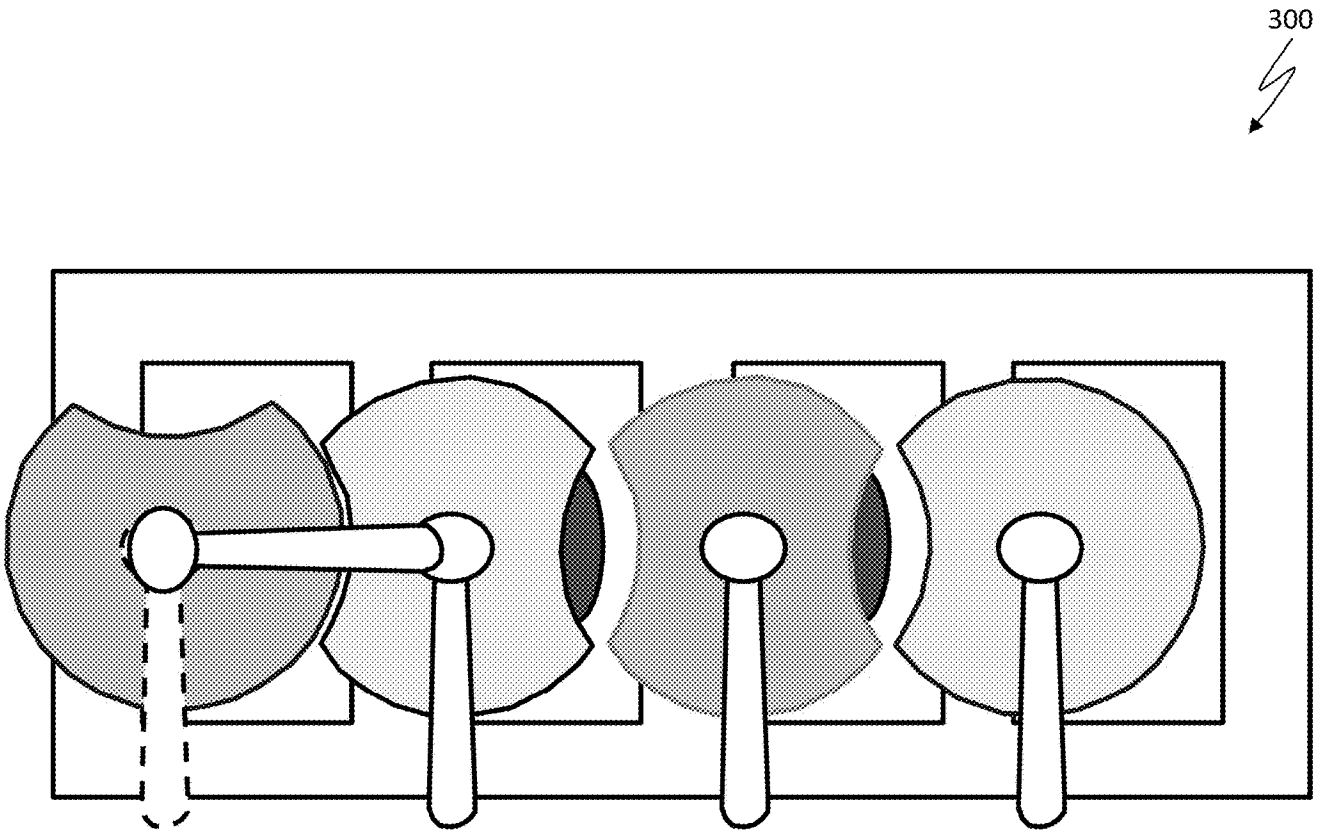
FIG. 26 is a front sectional view of the interlock article of FIG. 25 showing the orientation of the first and second limiter plates of FIG. 19 and the first and second limiter adapter plates of FIG. 20, when the first interlock handle is configured in the second configuration and the second, third and fourth interlock handles are configured in the first configuration.
Figure 27:
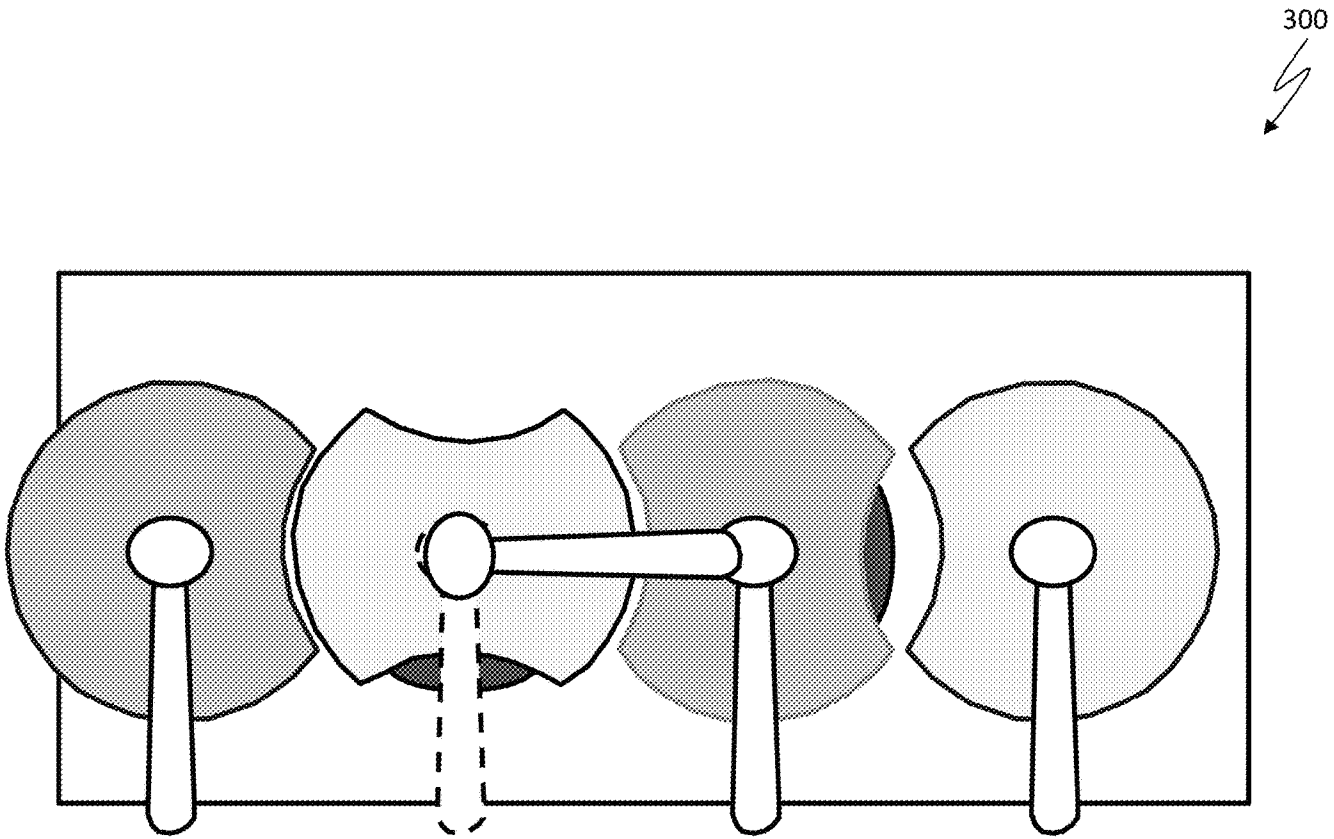
FIG. 27 is a front sectional view of the interlock article of FIG. 25 showing the orientation of the first and second limiter plates of FIG. 19 and the first and second limiter adapter plates of FIG. 20, when the second interlock handle is configured in the second configuration and the first, third and fourth interlock handles are configured in the first configuration.
Figure 28:
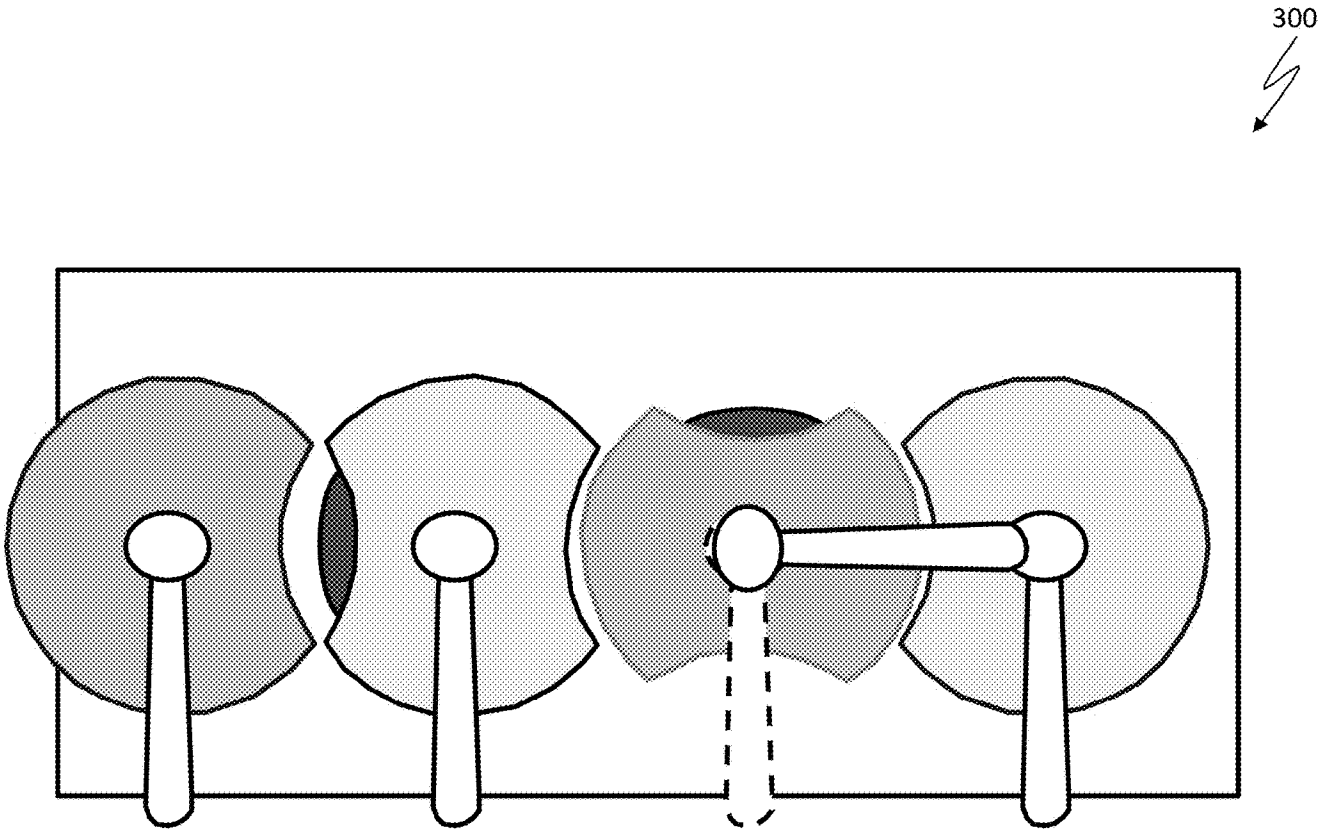
FIG. 28 is a front sectional view of the interlock article of FIG. 25 showing the orientation of the first and second limiter plates of FIG. 19 and the first and second limiter adapter plates of FIG. 20, when the third interlock handle is configured in the second configuration and the first, second and fourth interlock handles are configured in the first configuration.
Figure 29:
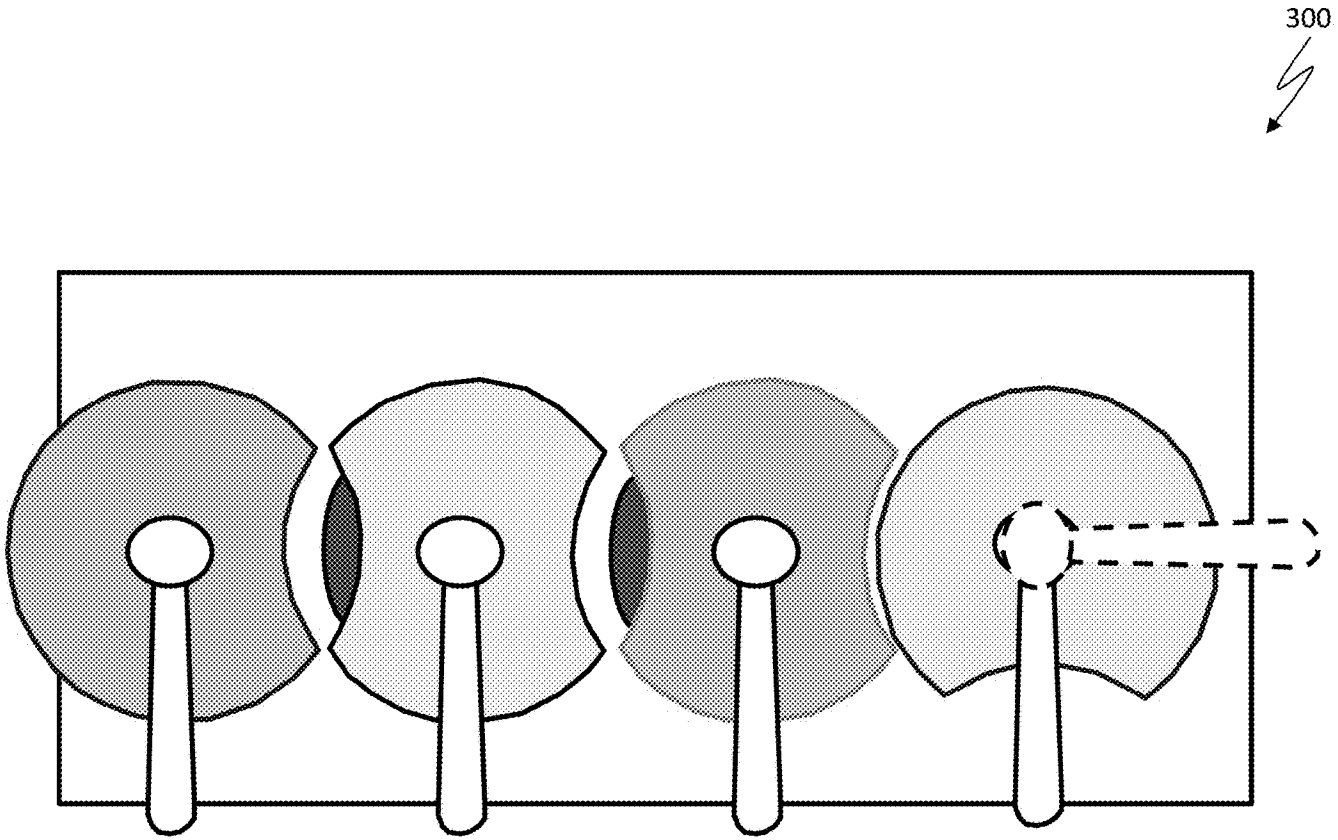
FIG. 29 is a front sectional view of the interlock article of FIG. 25 showing the orientation of the first and second limiter plates of FIG. 19 and the first and second limiter adapter plates of FIG. 20, when the fourth interlock handle is configured in the second configuration and the first second and third interlock handles are configured in the first configuration.

Referring to FIG. 22, the first interlock handle 214 is shown in the second configuration and the second interlock handle 216 and third interlock handle 218 are configured in the first configuration. It should be appreciated that as the first interlock handle 214 is configured from the first configuration to the second configuration, the first limiter plate 220 compresses the configurable adapter plug 212 allowing the first limiter plate 220 to rotate and causing the configurable adapter plug 212 to protrude out of the second adapter plat interface surface 210. This arrangement prevents the second limiter plate 226 from being able to rotate. Accordingly, only the first circuit breaker can be active. Referring to FIG. 23, the second interlock handle 216 is shown in the second configuration and the first interlock handle 214 and third interlock handle 218 are configured in the first configuration. This arrangement prevents the first limiter plate 220 and second limiter plate 226 from being able to rotate. Accordingly, only the second circuit breaker can be active. Referring to FIG. 24, the third interlock handle 218 is shown in the second configuration and the first interlock handle 214 and second interlock handle 216 are configured in the first configuration. This arrangement prevents the first limiter plate 220 and the limiter plate adapter 204 from being able to rotate. Accordingly, only the third circuit breaker can be active. It should be appreciated that using multiples of the limiter plate adapter 204 allows for as the interlock article 100, 200 to be used with as many circuit breaker switches as desired. This is shown in FIGS. 25-29 which illustrate an interlock article 300 in accordance with still yet another embodiment.

Figure 30:
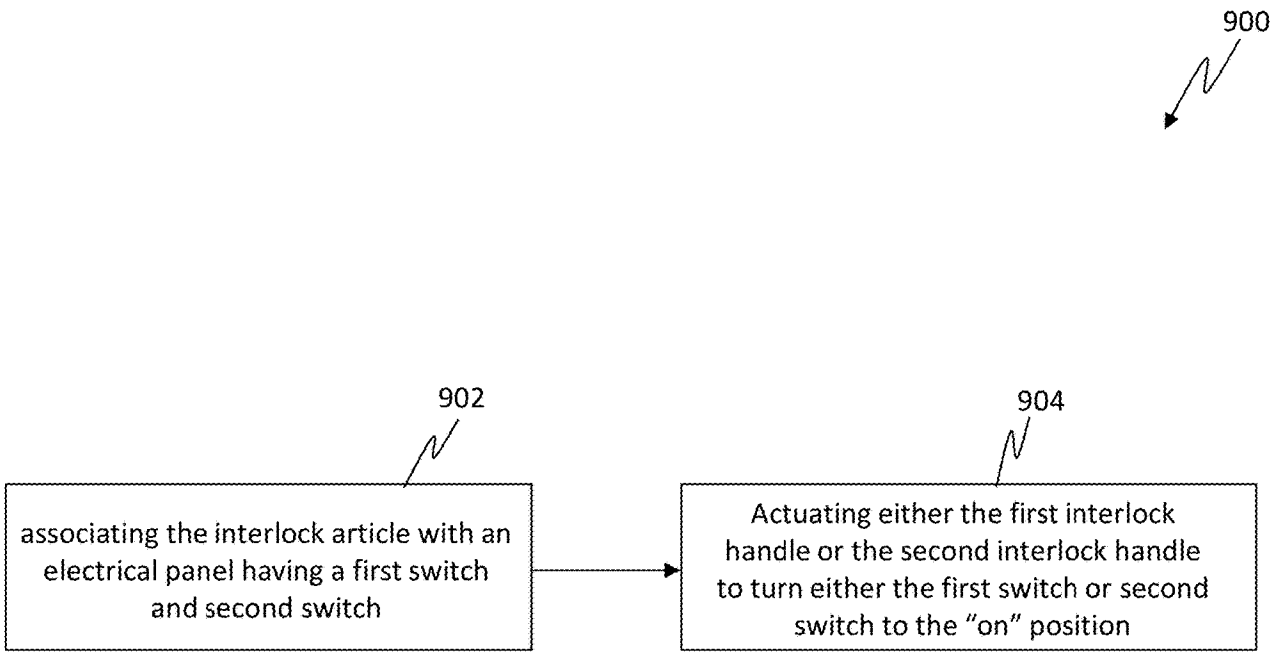
FIG. 30 is an operational block diagram illustrating a method for preventing more than one switch in an electrical panel from being turned on at once, in accordance with one embodiment.

Referring to FIG. 30, a block diagram illustrating a method 900 for preventing more than one switch in an electrical panel from being turned on at once is shown, in accordance with one embodiment and includes associating the interlock article 100 with an electrical panel having a first switch and second switch, as disclosed herein and as shown in operational block 902, wherein the first limiter plate 110 is proximate to and associated with the first switch and the second limiter plate 118 is proximate to and associated with the second switch. The method 900 further includes actuating either the first interlock handle 106 or the second interlock handle 114, as shown in operational block 904. If the first interlock handle 106 is actuated, then this causes the first limiter plate 110 to rotate about an axis and engage the first switch (i.e. turn the first switch from one position to another (i.e. "off" to "on")) while physically limiting the rotation of the second limiter plate 118, thus preventing the second switch from being moved from one position to another position (i.e. prevents the second switch from being turned "on"). If the second interlock handle 114 is actuated, then this causes the second limiter plate 118 to rotate about an axis and engage the second switch (i.e. turn the second switch from one position to another (i.e. "off" to "on")) while physically limiting the rotation of the first limiter plate 110, thus preventing the first switch from being moved from one position to another position (i.e. prevents the first switch from being turned "on"). It should be appreciated that this approach and method may be extended for use with electrical panels with more than two switches.

It should be appreciated that although the invention is disclosed herein with regards to an electrical panel (or circuit breaker panel) having a plurality of breaker switches, it is contemplated that the invention may be applied to any panel that incorporates actuators (or switches). Additionally, although the limiter plates are discussed as being associated with the shafts of each handle, other embodiments which use different arrangements are contemplated to be within the scope of the invention. For example, the limiter places do not necessarily have to be directly associated with the shaft of the handles and may be indirectly associated via gears, servos, belts, etc.

It should be appreciated that although the invention has been described as a mechanical interlock, the invention may be embodied, in whole or in part, via software, firmware and/or hardware. Moreover, it should be appreciated that although the invention may be implemented, in whole or in part, via software, hardware, firmware and/or any combination thereof, it is also contemplated that a method for carrying out the operation of the invention may also be implemented, in whole or in part, without the use of software, hardware, firmware and/or any combination thereof.

Moreover, it should be appreciated that each of the elements of the present invention may be implemented in part, or in whole, in any order suitable to the desired end purpose. In accordance with an exemplary embodiment, the processing required to practice the method of the present invention, either in whole or in part, may be implemented, wholly or partially, by a controller operating in response to a machine-readable computer program. In order to perform the prescribed functions and desired processing, as well as the computations therefore (e.g. execution control algorithm(s), the control processes prescribed herein, and the like), the controller may include, but not be limited to, a processor(s), computer(s), memory, storage, register(s), timing, interrupt(s), communication interface(s), and input/output signal interface(s), as well as combination comprising at least one of the foregoing. It should also be appreciated that the embodiments disclosed herein are for illustrative purposes only and include only some of the possible embodiments contemplated by the present invention.

Furthermore, the invention may be wholly or partially embodied in the form of a computer system or controller implemented processes. It should be appreciated that any type of computer system (as is well known in the art) may be used and that the invention may be implemented via any type of network setup, including but not limited to a LAN and/or a WAN (wired or wireless). The method of the invention may also be embodied in the form of computer program code containing instructions embodied in tangible media, such as floppy diskettes, CD-ROMs, hard drives, and/or any other computer-readable medium, wherein when the computer program code is loaded into and executed by a computer or controller, the computer or controller becomes an apparatus for practicing the invention. When implemented on a general-purpose controller the computer program code segments may configure the controller to create specific logic circuits.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

I claim:

1. An interlock for a circuit breaker having a first circuit breaker switch and a second circuit breaker switch, the interlock comprising:

an interlock housing;

a first actuator movably associated with the first circuit breaker switch;

a first limiter plate, and a first handle securely associated with the first actuator and first limiter plate, wherein the first handle is rotatably associated with the interlock housing to be configurable between a first handle first configuration and a first handle second configuration;

a second actuator movably associated with the second circuit breaker switch;

a second limiter plate, and a second handle securely associated with the second actuator and second limiter plate, wherein the second handle is rotatably associated with the interlock housing to be configurable between a second handle first configuration and a second handle second configuration, wherein, when the first handle is in the first handle first configuration, the second handle is configurable between the second handle first configuration and the second handle second configuration, and when the first handle is in the first handle second configuration, the second handle is configured in the second handle first configuration and prevented from being configured into the second handle second configuration by the first limiter plate and the second limiter plate is prevented from rotating by the first limiter plate, and when the second handle is in the second handle first configuration, the first handle is configurable between the first handle first configuration and the first handle second configuration, and when the second handle is in the second handle second configuration, the first handle is configured in the first handle first configuration and prevented from being configured into the first handle second configuration by the second limiter plate and the first limiter plate is prevented from rotating by the second limiter plate.

2. The interlock of claim 1, wherein the first actuator, first limiter plate and first handle are securely associated via a first handle shaft, and wherein the second actuator, second limiter plate and second handle are securely associated via a second handle shaft.

3. The interlock of claim 1, wherein the circuit breaker includes a circuit breaker housing and wherein the interlock housing is securely associated with the circuit breaker housing.

4. The interlock of claim 1, wherein the first actuator is rotatably configurable between a first actuator first configuration and a first actuator second configuration and wherein the second actuator is rotatably configurable between a second actuator first configuration and a second actuator second configuration.

5. The interlock of claim 1, wherein the first actuator is configurable between a first actuator first configuration and a first actuator second configuration, wherein when the first handle is in the first handle first configuration, the first actuator is in the first actuator first configuration and when the first handle is in the first handle second configuration, the first actuator is in the first actuator second configuration.

6. The interlock of claim 5, wherein when the first actuator is configured in the first actuator first configuration, the first circuit breaker switch is configured in the off position and when the first actuator is configured in the first actuator second configuration, the first circuit breaker switch is configured in the on position.

7. The interlock of claim 1, wherein the second actuator is configurable between a second actuator first configuration and a second actuator second configuration, wherein when the second handle is in the second handle first configuration, the second actuator is in the second actuator first configuration and when the second handle is in the second handle second configuration, the second actuator is in the second actuator second configuration.

8. The interlock of claim 7, wherein when the second actuator is configured in the second actuator first configuration, the second circuit breaker switch is configured in the off position and when the second actuator is configured in the second actuator second configuration, the second circuit breaker switch is configured in the on position.

9. The interlock of claim 1, wherein when the first handle is in the first handle first configuration, the first limiter plate is configured in a first plate first configuration and when the first handle is in the first handle second configuration, the first limiter plate is configured in a first plate second configuration, and when the second handle is in the second handle first configuration, the second limiter plate is configured in a second plate first configuration and when the second handle is in the second handle second configuration, the second limiter plate is configured in a second plate second configuration.

10. The interlock of claim 9, wherein when the first limiter plate is configured in the first plate second configuration, the first limiter plate limits movement of the second limiter plate, and when the second limiter plate is configured in the second plate second configuration, the second limiter plate limits movement of the first limiter plate.

11. An interlock for a panel having a first switch and a second switch, the interlock comprising:

a first actuator movably associated with the first switch;

a first limiter plate, and a first handle securely associated with the first actuator and the first limiter plate, wherein the first limiter plate is rotatably configurable between a first plate first configuration and a first plate second configuration;

a second actuator movably associated with the second switch;

a second limiter plate, and a second handle securely associated with the second actuator and the second limiter plate, wherein the second limiter plate is rotatably configurable between a second plate first configuration and a second plate second configuration, wherein, when the first limiter plate is in the first plate second configuration, the second limiter plate is configured in the second plate first configuration and prevented from being configured into the second plate second configuration by the first limiter plate, and when the second limiter plate is in the second plate second configuration, the first limiter plate is configured in the first plate first configuration and prevented from being configured into the first plate second configuration by the second limiter plate.

12. The interlock of claim 11, wherein the interlock includes an interlock housing and wherein the panel includes a panel housing and wherein the interlock housing is securely associated with the panel housing via an attaching means.

13. The interlock of claim 11, wherein the panel includes a third switch and wherein the interlock further comprises, a third actuator movably associated with the third switch;

a third limiter plate, and a third handle securely associated with the third actuator and the third limiter plate, wherein the third limiter plate is configurable between a third plate first configuration and a third plate second configuration.

14. The interlock of claim 13, wherein when the first limiter plate is in the first plate second configuration, the second limiter plate is non-movably configured in the second plate first configuration and the third limiter plate is non-movably configured in the third plate first configuration, when the second limiter plate is in the second plate second configuration, the first limiter plate is non-movably configured in the first plate first configuration and the third limiter plate is non-movably configured in the third plate first configuration, and when the third limiter plate is in the third plate second configuration, the first limiter plate is non-movably configured in the first plate first configuration and the second limiter plate is non-movably configured in the second plate first configuration.

15. The interlock of claim 14, wherein the first actuator is configurable between a first actuator first configuration and a first actuator second configuration, wherein when the first limiter plate is in the first plate first configuration, the first actuator is in the first actuator first configuration and when the first limiter plate is in the first plate second configuration, the first actuator is in the first actuator second configuration.

16. The interlock of claim 15, wherein when the first actuator is configured in the first actuator first configuration, the first switch is configured in the off position and when the first actuator is configured in the first actuator second configuration, the first switch is configured in the on position.

17. The interlock of claim 14, wherein the second actuator is configurable between a second actuator first configuration and a second actuator second configuration, wherein when the second limiter plate is in the second plate first configuration, the second actuator is in the second actuator first configuration and when the second limiter plate is in the second plate second configuration, the second actuator is in the second actuator second configuration.

18. The interlock of claim 17, wherein when the second actuator is configured in the second actuator first configuration, the second switch is configured in the off position and when the second actuator is configured in the second actuator second configuration, the second switch is configured in the on position.

19. The interlock of claim 14, wherein the third actuator is configurable between a third actuator first configuration and a third actuator second configuration, wherein when the third limiter plate is in the third plate first configuration, the third actuator is in the third actuator first configuration and when the third limiter plate is in the third plate second configuration, the third actuator is in the third actuator second configuration.

20. The interlock of claim 19, wherein when the third actuator is configured in the third actuator first configuration, the third switch is configured in the off position and when the third actuator is configured in the third actuator second configuration, the third switch is configured in the on position.

* * * * *